US007385581B2

(12) United States Patent
Kojima et al.

(10) Patent No.: US 7,385,581 B2
(45) Date of Patent: Jun. 10, 2008

(54) DRIVING VOLTAGE CONTROL DEVICE, DISPLAY DEVICE AND DRIVING VOLTAGE CONTROL METHOD

(75) Inventors: Tomokazu Kojima, Ibaraki (JP); Tsutomu Sakakibara, Otsu (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 508 days.

(21) Appl. No.: 11/071,168

(22) Filed: Mar. 4, 2005

(65) Prior Publication Data

US 2005/0200586 A1 Sep. 15, 2005

(30) Foreign Application Priority Data

Mar. 11, 2004 (JP) ..... 2004-068596

(51) Int. Cl.
*G09G 3/36* (2006.01)

(52) U.S. Cl. ..... 345/96; 345/98; 345/100; 345/95; 345/94

(58) Field of Classification Search ..... 345/76, 345/82, 94, 95, 98, 100, 204, 211, 96, 147, 345/89, 208; 330/255; 374/170; 323/234; 327/536; 365/59, 63; 307/110
See application file for complete search history.

(56) References Cited

U.S. PATENT DOCUMENTS 5,095,223 A * 3/1992 Thomas ..... 307/110
5,581,454 A * 12/1996 Collins ..... 363/59
5,754,151 A * 5/1998 Moon ..... 345/92
6,064,358 A * 5/2000 Kitajima et al. ..... 345/88
6,466,191 B1 * 10/2002 Choi et al. ..... 345/94
6,509,895 B2 * 1/2003 Yanagi et al. ..... 345/211
6,822,632 B2 * 11/2004 Lee et al. ..... 345/95
6,869,216 B1 * 3/2005 Holloway et al. ..... 374/170
7,042,276 B2 * 5/2006 Tanaka ..... 327/536

(Continued)

FOREIGN PATENT DOCUMENTS

JP 2000-010079 1/2000

(Continued)

OTHER PUBLICATIONS

Japanese Office Action, with English Translation, issued in Japanese Patent Application No. JP 2005-035938, mailed on March 11, 2008.

*Primary Examiner*—Prabodh Dharia
(74) *Attorney, Agent, or Firm*—McDermott Will & Emery LLP

(57) ABSTRACT

A driving voltage control device includes a first to fourth capacitor, and an output section. In the first mode, the first capacitor receives a first voltage and stores a corresponding amount of charge, the second capacitor receives a second voltage and stores a corresponding amount of charge, and the output section supplies either one of a voltage according to the amount of charge stored in the first capacitor or second capacitor to a first output node according to a predetermined timing. In the second mode, the third capacitor receives a third voltage and stores a corresponding amount of charge, the fourth capacitor receives a fourth voltage and stores a corresponding amount of charge, and the output section supplies either one of a voltage according to the amount of charge stored in the third capacitor or fourth capacitor to a second output node according to a predetermined timing.

15 Claims, 11 Drawing Sheets

U.S. PATENT DOCUMENTS

| | | | | |
|---|---|---|---|---|
| 7,119,802 | B2 * | 10/2006 | Suyama et al. | 345/208 |
| 7,133,018 | B2 * | 11/2006 | Kim et al. | 345/100 |
| 7,154,332 | B2 * | 12/2006 | Tsuchi | 330/255 |
| 2002/0149575 | A1 * | 10/2002 | Moon | 345/204 |
| 2003/0103368 | A1 * | 6/2003 | Arimoto et al. | 365/63 |
| 2003/0151581 | A1 * | 8/2003 | Suyama et al. | 345/98 |
| 2004/0012553 | A1 | 1/2004 | Lee et al. | |
| 2005/0073490 | A1 * | 4/2005 | Kojima et al. | 345/87 |
| 2006/0012588 | A1 * | 1/2006 | Shinohara | 345/204 |
| 2006/0066602 | A1 * | 3/2006 | Date | 345/204 |
| 2006/0125739 | A1 * | 6/2006 | Tsutsui | 345/76 |
| 2007/0145958 | A1 * | 6/2007 | Miyake et al. | 323/234 |

FOREIGN PATENT DOCUMENTS

| | | |
|---|---|---|
| JP | 2003-216256 | 7/2003 |

* cited by examiner

"PRIOR ART"

"PRIOR ART"

DRIVING VOLTAGE CONTROL DEVICE, DISPLAY DEVICE AND DRIVING VOLTAGE CONTROL METHOD

CROSS REFERENCE TO RELATED APPLICATION

This application claims priority under 35 U.S.C. §119 on Patent Application No. 2004-068596 filed in Japan on Mar. 11, 2004, the entire contents of which are hereby incorporated by reference.

BACKGROUND OF THE INVENTION

1. Field of the Invention

The present invention relates to a device and method for controlling a driving voltage, and more particularly to a device and method for outputting a suitable driving voltage for each of a plurality of devices (e.g., liquid crystal display panels).

2. Description of the Background Art

Driving voltage control devices in which the bias current of an operational amplifier is controlled so as to reduce the power consumption while the circuit area is reduced so as to prevent an increase in cost are known in the art (see, for example, Japanese Laid-Open Patent Publication No. 2003-216256). With a driving voltage control device disclosed in Japanese Laid-Open Patent Publication No. 2003-216256, it is possible to suitably drive a single liquid crystal display panel.

Recently, more portable devices such as mobile telephones have more than one liquid crystal display panels. With such a product, it is necessary to supply an optimal driving voltage to each of the liquid crystal display panels. Conventionally, the same number of driving voltage control devices as the number of liquid crystal display panels are provided.

However, with a mobile telephone having two liquid crystal display screens, one on the front and one on the back, for example, it is often the case that the main liquid crystal display screen (main liquid crystal display panel; hereinafter referred simply as "main panel") and the sub-liquid crystal display screen (sub-liquid crystal display panel; hereinafter referred simply as "sub-panel") are not viewed at the same time. In such a case, providing a single driving voltage control device capable of supplying an optimal driving voltage to one of the liquid crystal display panels that is being viewed by the user is preferable in terms of cost, for example, to providing the same number of driving voltage control devices as the number of liquid crystal display panels.

Conventional Driving Voltage Control Device

FIG. 10 shows a general configuration of a conventional driving voltage control device 9. The device 9 includes a timing control section 901, a VCOM voltage generation section 902, a VCOMH operational amplifier 903H, a VCOML operational amplifier 903L, smoothing capacitors C904-H and C904-L, switches SW5 to SW8 and output terminals 905M and 905S. The device 9 supplies a different set of optimal driving voltages VCOMH and VCOML to the counter electrode (not shown) of the main panel and to that of the sub-panel (i.e., the device 9 generates two different sets of driving voltages VCOMH and VCOML). The driving voltages VCOMH and VCOML are voltages that are used for driving the counter electrode of the main panel and that of the sub-panel.

The VCOM voltage generation section 902 generates the driving voltages VCOMH and VCOML according to the control signals Sa and Sb output from the timing control section 901. For example, the VCOM voltage generation section 902 may be an RDAC (Resistance Digital Analog Converter) and have a configuration as shown in FIG. 2.

The smoothing capacitors C904-H and C904-L each have a capacitance value on the order of . F (microfarads).

Operation

Next, an operation of the driving voltage control device 9 shown in FIG. 10 will be described with reference to FIG. 4A to FIG. 4D and FIG. 11A and FIG. 11B.

Period T1-T4

During the period T1-T4, the driving voltage control device 9 controls the driving voltages VCOMH and VCOML to be output to the counter electrode of the main panel.

When a state indicating signal STATE is received, the timing control section 901 outputs the control signals Sa and Sb to the VCOM voltage generation section 902 and brings control signals S7 and S8 to "H level" and "L level", respectively. The timing control signal Sa indicates the voltage value of the driving voltage VCOMH to be generated by the VCOM voltage generation section 902. The control signal Sb indicates the voltage value of the driving voltage VCOMH to be generated by the VCOM voltage generation section 902. In the illustrated example, during the period T1-T4, the control signal Sa indicates a voltage value of "+3 V" and the control signal Sb indicates a voltage value of "−3 V".

Then, the VCOM voltage generation section 902 generates the driving voltages VCOMH and VCOML according to the control signals Sa and Sb.

Then, the VCOMH operational amplifier 903H outputs the driving voltage VCOMH generated by the VCOM voltage generation section 902. The VCOML operational amplifier 903L outputs the driving voltage VCOML generated by the VCOM voltage generation section 902. Thus, the smoothing capacitor C904-H stores an amount of charge according to the voltage value (+3 V) of the driving voltage VCOMH, and the smoothing capacitor C904-L stores an amount of charge according to the voltage value (−3 V) of the driving voltage VCOML.

In response to a timing signal TIMING, the timing control section 901 alternately brings control signals S5 and S6 to "H level". Therefore, the output from the output terminal 905M alternates between "−3 V" and "+3 V" at intervals of one time segment, as shown in FIG. 11A.

Period T6-T9

During the period T6-T9, the driving voltage control device 9 controls the driving voltages VCOMH and VCOML to be output to the counter electrode of the sub-panel.

When the state indicating signal STATE is received, the timing control section 901 outputs the control signals Sa and Sb to the VCOM voltage generation section 902 and brings the control signals S5 and S6 to "H level" and "L level", respectively. In the illustrated example, during the period T6-T9, the control signal Sa indicates a voltage value of "+2 V" and the control signal Sb indicates a voltage value of "−2.5 V".

Then, the VCOM voltage generation section 902, the VCOMH operational amplifier 903H and the VCOML operational amplifier 903L perform an operation similar to that during the period T1-T4. Thus, the smoothing capacitor C904-H stores an amount of charge according to the voltage value (+2 V) of the driving voltage VCOMH, and the smoothing capacitor C904-L stores an amount of charge according to the voltage value (−2.5 V) of the driving voltage VCOML.

In response to the timing signal TIMING, the timing control section 901 alternately brings control signals S7 and S8 to "H level". Therefore, the output from the output terminal 905S alternates between "−2.5 V" and "+2 V" at intervals of one time segment, as shown in FIG. 11B.

Period T5

In the period T5, the timing control section 901 newly receives the state indicating signal STATE indicating "sub-panel driving operation", and changes the control signals Sa and Sb. Specifically, the voltage value indicated by the control signal Sa is changed from "+3 V" to "+2 V", and the voltage value indicated by the control signal Sb is changed from "−3 V" to "−2.5 V". The voltage values of the driving voltages VCOMH and VCOML generated by the VCOM voltage generation section 902 are changed as described above.

Thus, the conventional driving voltage control device 9 supplies the driving voltages VCOMH and VCOML of suitable values to the counter electrode of each of the main panel and the sub-panel.

SUMMARY OF THE INVENTION

However, with the conventional driving voltage control device 9 shown in FIG. 10, in the period in which the operation is switched from the main panel driving operation to the sub-panel driving operation (the period T5), a smoothing capacitor C104-H transitions from a state where it stores a charge corresponding to the potential difference (3 V) between the driving voltage VCOMH (+3 V) and the ground node (GND) to another state where it stores a charge corresponding to the potential difference (2 V) between the driving voltage (+2 V) and the ground node (GND). Therefore, a charge corresponding to the voltage difference (1 V) is discharged. Moreover, in the period in which the operation is switched from the sub-panel driving operation to the main panel driving operation, the smoothing capacitor C104-H needs to be charged with a charge corresponding to the voltage difference (1 V).

Due to the limitations required for displaying an image on a liquid crystal display panel, the switches SW5 to SW8 are typically turned on/off every 30 to 100. s (microseconds). As described above, the smoothing capacitors C104-H and C104-L have a capacitance value on the order of . F (a typical value of 4.7·F is used herein). Therefore, in order to complete the charging/discharging with a charge corresponding to 1 V within 30. s, the VCOMH operational amplifier 903H and the VCOML operational amplifier 903L need to have a high current capacity exceeding 100 mA. Then, it is necessary to increase the size of current-driving transistors included in the operational amplifiers 903H and 903L, thereby increasing the overall area of the liquid crystal display device on which the driving voltage control device is to be placed.

Moreover, the conventional driving voltage control device 9 loses a substantial amount of charge as it requires charging/discharging with a charge corresponding to 1 V. For example, if the smoothing capacitor C904-H has a capacitance value of 1. F and a load capacitor C(M) of the main panel has a capacitance value of 20 nF, the amount of charge consumed when driving the main panel by an AC driving method (e.g., line inversion driving method) is 120 nC (nanocoulombs), whereas the amount of charge consumed when switching between the main panel driving operation and the sub-panel driving operation is 1. C. Thus, an extra charge about ten times as much as that required for driving the main panel is consumed for the switching, thereby significantly increasing the overall power consumption of the liquid crystal display driver in which the driving voltage control device 9 is used.

According to one aspect of the present invention, a driving voltage control device operates in a first mode and in a second mode. The driving voltage control device includes a first capacitor, a second capacitor, a third capacitor, a fourth capacitor and an output section. In the first mode, the first capacitor receives a first voltage and stores an amount of charge according to a voltage value of the first voltage; the second capacitor receives a second voltage and stores an amount of charge according to a voltage value of the second voltage; and the output section supplies either one of a voltage according to the amount of charge stored in the first capacitor and a voltage according to the amount of charge stored in the second capacitor to a first output node according to a predetermined timing. In the second mode, the third capacitor receives a third voltage and stores an amount of charge according to a voltage value of the third voltage; the fourth capacitor receives a fourth voltage and stores an amount of charge according to a voltage value of the fourth voltage; and the output section supplies either one of a voltage according to the amount of charge stored in the third capacitor and a voltage according to the amount of charge stored in the fourth capacitor to a second output node according to a predetermined timing.

Where there are two units to be driven, this driving voltage control device can supply two voltages (the first voltage and the second voltage) having voltage values suitable for one unit to be driven (device A) to the device A in the first mode, and supply two voltages (the third voltage and the fourth voltage) having voltage values suitable for the other unit to be driven (device B) to the device B in the second mode. Thus, it is possible to supply an optimal voltage to each of the units to be driven. Moreover, since the capacitors used in the first mode (the first capacitor and the second capacitor) are different from those used in the second mode (the third capacitor and the fourth capacitor), it is not necessary to charge/discharge the first to fourth capacitors for each mode. Thus, it is possible to prevent charge from being wasted when switching from one mode to another. Since it is not necessary to charge/discharge the first to fourth capacitors for each mode, it is possible to quickly switch between the first mode and the second mode.

Preferably, the driving voltage control device further includes a voltage generation section. In the first mode, the voltage generation section generates the first and second voltages; the first capacitor receives the first voltage generated by the voltage generation section; and the second capacitor receives the second voltage generated by the voltage generation section. In the second mode, the voltage generation section generates the third and fourth voltages; the third capacitor receives the third voltage generated by the voltage generation section; and the fourth capacitor receives the fourth voltage generated by the voltage generation section.

In this driving voltage control device, the voltage generation section generates voltages of different voltage values for different modes. Therefore, it is possible appropriately supply the first to fourth voltages to the first to fourth capacitors.

Preferably, the driving voltage control device further includes a first differential amplifier circuit and a second differential amplifier circuit. In the first mode, the first differential amplifier circuit outputs the first voltage generated by the voltage generation section; the second differential amplifier circuit outputs the second voltage generated by the voltage generation section; the first capacitor receives the first voltage output by the first differential amplifier circuit; and the second capacitor receives the second voltage output by the second differential amplifier circuit. In the second mode, the first differential amplifier circuit outputs the third voltage generated by the voltage generation section; the second differential amplifier circuit outputs the fourth voltage generated by the voltage generation section; the first capacitor receives the third voltage output by the first differential amplifier circuit; and the second capacitor receives the fourth voltage output by the second differential amplifier circuit.

In this driving voltage control device, it is possible with the first differential amplifier circuit to stably supply the first voltage (or the third voltage) to the first capacitor (or the third capacitor). Moreover, it is possible with the second differential amplifier circuit to stably supply the second voltage (or the fourth voltage) to the second capacitor (or the fourth capacitor).

Preferably, the voltage generation section includes a first supply terminal and a second supply terminal, and the driving voltage control device further includes: a first switch connected between the first supply terminal and the first capacitor; a second switch connected between the second supply terminal and the second capacitor; a third switch connected between the first supply terminal and the third capacitor; and a fourth switch connected between the second supply terminal and the fourth capacitor. In the first mode, the first supply terminal outputs the first voltage; the second supply terminal outputs the second voltage; the first and second switches are turned on; and the third and fourth switches are turned off. In the second mode, the first supply terminal outputs the third voltage; the second supply terminal outputs the fourth voltage; the first and second switches are turned off; and the third and fourth switches are turned on.

In this driving voltage control device, the third capacitor (or the fourth capacitor) is disconnected from the first supply terminal (or the second supply terminal) in the first mode, and the first capacitor (or the second capacitor) is disconnected from the first supply terminal (or the second supply terminal) in the second mode. Therefore, the first to fourth capacitors are disconnected with an amount of charge being stored therein, whereby it is not necessary to charge/discharge the first to fourth capacitors for each mode. Thus, it is possible to prevent charge from being wasted when switching from one mode to another. Since it is not necessary to charge/discharge the first to fourth capacitors for each mode, it is possible to quickly switch between the first mode and the second mode.

Preferably, the driving voltage control device is brought to a switching mode when switching between the first mode and the second mode, with the first to fourth switches being all turned off during the switching mode.

With this driving voltage control device, the first to fourth capacitors are all disconnected from the voltage generation section, whereby it is possible to reliably cut off the paths via which the first to fourth capacitors are charged/discharged.

Preferably, in the first mode, the output section further supplies either one of a voltage according to the amount of charge stored in the first capacitor and a voltage according to the amount of charge stored in the second capacitor to the second output node.

With this driving voltage control device, in the first mode, the first voltage and the second voltage each having a voltage value suitable for the device A to be driven in the first mode are supplied to the device A while supplying the first voltage (or the second voltage) to the device B, which is not driven in the first mode. Thus, the potential of the device B can be fixed by the first voltage (or the second voltage). Where the device B is a liquid crystal display panel, for example, it is possible to reduce the visual unnaturalness to be perceived on the device B, i.e., a display panel not being driven.

Preferably, in the first mode, the output section further supplies either one of a voltage according to the amount of charge stored in the third capacitor and a voltage according to the amount of charge stored in the fourth capacitor to the second output node.

With this driving voltage control device, in the first mode, the first voltage and the second voltage each having a voltage value suitable for the device A to be driven in the first mode are supplied to the device A while supplying the third voltage (or the fourth voltage) to the device B, which is not driven in the first mode. Thus, the potential of the device B can be fixed by the first voltage (or the second voltage) having a voltage value suitable for the device B. Where the device B is a liquid crystal display panel, for example, it is possible to reduce the visual unnaturalness to be perceived on the device B, i.e., a display panel not being driven.

Preferably, the driving voltage control device further includes: a first line having first to sixth nodes, the third to sixth nodes being present between the first node and the second node; and a second line having seventh to twelfth nodes, the ninth to twelfth nodes being present between the seventh node and the eighth node. The output section includes: a fifth switch connected between the third node and the first output node; a sixth switch connected between the ninth node and the first output node; a seventh switch connected between the fourth node and the second output node; and an eighth switch connected between the tenth node and the second output node. The first supply terminal is connected to the first node. The second supply terminal is connected to the seventh node. The first switch is connected between the fifth node and the first capacitor. The second switch is connected between the eleventh node and the second capacitor. The third switch is connected between the sixth node and the third capacitor. The fourth switch is connected between the twelfth node and the fourth capacitor. In the first mode, the fifth and sixth switches are turned on/off according to a predetermined timing. In the second mode, the seventh and eighth switches are turned on/off according to a predetermined timing.

Preferably, in the first mode, one of the seventh switch and the eighth switch is turned on.

Preferably, the driving voltage control device further includes a ninth switch connected between the second output node and one of the third capacitor and the fourth capacitor. In the first mode, the ninth switch is turned on. In the second mode, the ninth switch is turned off.

According to another aspect of the present invention, a display device includes a driving voltage control device as set forth above, a first display panel, a first source driver, a second display panel and a second source driver. The first display panel receives, at a counter electrode thereof, a voltage supplied to the first output node included in the driving voltage control device. The first source driver supplies a data signal to the first display panel. The second display panel receives, at a counter electrode thereof, a voltage supplied to the second output node included in the driving voltage control device. The second source driver supplies a data signal to the second display panel.

With this display device, two display panels can be driven with one driving voltage control device. Thus, it is possible to reduce the circuit scale of the display device.

According to still another aspect of the present invention, a driving voltage control device supplies a predetermined voltage to a counter electrode of each of a first display panel and a second display panel. The driving voltage control device operates in a first mode and in a second mode. The driving voltage control device includes a first capacitor, a second capacitor, a third capacitor, a fourth capacitor, and an output section. In the first mode, the first capacitor receives a first voltage and stores an amount of charge according to a voltage value of the first voltage; the second capacitor receives a second voltage and stores an amount of charge according to a voltage value of the second voltage; and the output section supplies either one of a voltage according to the amount of charge stored in the first capacitor and a voltage according to the amount of charge stored in the second capacitor to the counter electrode of the first display panel according to a predetermined timing. In the second mode, the third capacitor receives a third voltage and stores an amount of charge according to a voltage value of the third voltage; the fourth capacitor receives a fourth voltage and stores an amount of charge according to a voltage value of the fourth voltage; and the output section supplies ether one of a voltage according to the amount of charge stored in the third capacitor and a voltage according to the amount of charge stored in the fourth capacitor to the counter electrode of the second display panel according to a predetermined timing.

According to yet another aspect of the present invention, a driving voltage control method has a first mode and a second mode, and includes a step (a), a step (b) and a step (c). In the first mode, the step (a) is a step of applying a first voltage to a first capacitor; the step (b) is a step of applying a second voltage to a second capacitor; and the step (c) is a step of supplying either one of a voltage according to the amount of charge stored in the first capacitor and a voltage according to the amount of charge stored in the second capacitor to a first output node according to a predetermined timing. In the second mode, the step (a) is a step of ap plying a third voltage to a third capacitor; the step (b) is a step of applying a fourth voltage to a fourth capacitor; and the step (c) is a step of supplying either one of a voltage according to the amount of charge stored in the third capacitor and a voltage according to the amount of charge stored in the fourth capacitor to a second output node according to a predetermined timing.

Where there are two units to be driven, it is possible with this driving voltage control method to supply a first voltage or a second voltage having a voltage value suitable for one unit to be driven (device A) to the device A in the first mode, and supply a third voltage or a fourth voltage having a voltage value suitable for the other unit to be driven (device B) to the device B in the second mode. Moreover, since the capacitors used in the first mode (the first capacitor and the second capacitor) are different from those used in the second mode (the third capacitor and the fourth capacitor), it is possible to prevent charge from being wasted when switching from one mode to another.

Preferably, the driving voltage control method further includes a step (d), wherein in the first mode, the step (d) is a step of supplying either one of a voltage according to the amount of charge stored in the first capacitor and a voltage according to the amount of charge stored in the second capacitor to the second output node.

Preferably, the driving voltage control method further includes a step (d), wherein in the first mode, the step (d) is a step of supplying either one of a voltage according to the amount of charge stored in the third capacitor and a voltage according to the amount of charge stored in the fourth capacitor to the second output node.

Thus, with the driving voltage control device of the present invention, it is possible to supply an optimal voltage to each of the units to be driven. Moreover, since the capacitors used in the first mode (the first capacitor and the second capacitor) are different from those used in the second mode (the third capacitor and the fourth capacitor), it is not necessary to charge/discharge the first to fourth capacitors for each mode. Thus, it is possible to prevent charge from being wasted when switching from one mode to another. Since it is not necessary to charge/discharge the first to fourth capacitors for each mode, it is possible to quickly switch between the first mode and the second mode.

DESCRIPTION OF THE PREFERRED EMBODIMENTS

Figure 1:
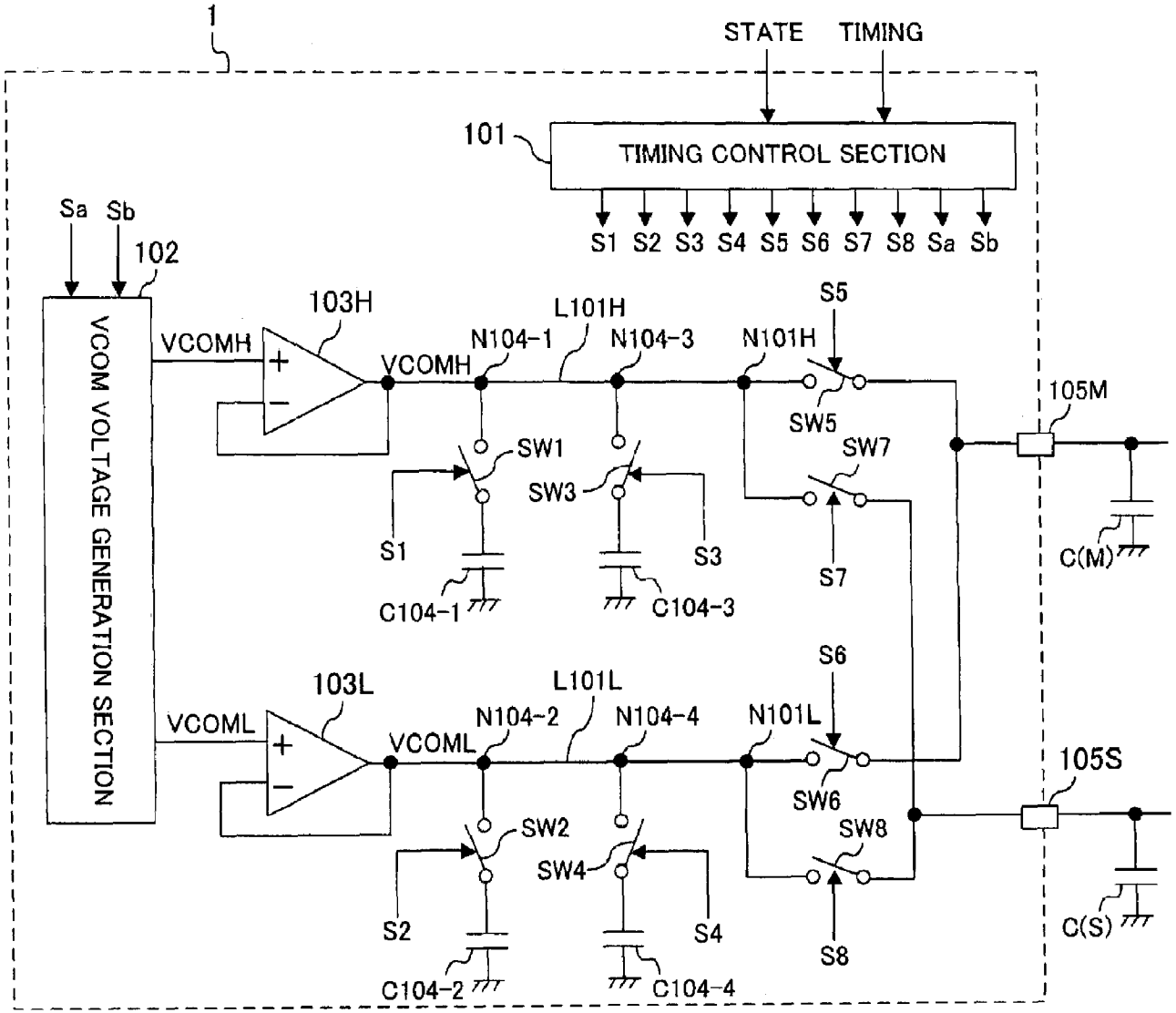
FIG. 1 shows a general configuration of a driving voltage control device according to a first embodiment of the present invention.

Preferred embodiments of the present invention will now be described in detail with reference to the drawings. Like elements are denoted by like reference numerals throughout the various figures, and will not be described repeatedly.

First Embodiment

General Configuration

FIG. 1 shows a general configuration of a driving voltage control device 1 according to a first embodiment of the present invention. The device 1 includes a timing control section 101, a VCOM voltage generation section 102, a VCOMH operational amplifier 103H, a VCOML operational amplifier 103L, switches SW1 to SW8, output terminals 105M and 105S, main-panel smoothing capacitors C104-1 and C104-2 and sub-panel smoothing capacitors C104-3 and C104-4. The device 1 controls the driving voltages VCOMH and VCOML for driving each of the main panel and the sub-panel by an AC driving method (e.g., line inversion driving method). For example, in a mobile telephone having two liquid crystal display screens (the main panel and the sub-panel), the driving voltage control device 1 supplies a different set of driving voltages VCOMH and VCOML to the counter electrode of the main panel and to that of the sub-panel (i.e., the driving voltage control device 1 outputs two different sets of driving voltages VCOMH and VCOML).

The timing control section 101 receives the state indicating signal STATE and the timing signal TIMING from outside, and outputs the control signals Sa, Sb and S1 to S4. The state indicating signal STATE indicates which one of the main panel and the sub-panel is driven. The timing signal TIMING indicates the time at which to switch the voltage level of each of the control signals S5 to S8 from "H level" to "L level" (or from "L level" to "H level"). The control signal Sa indicates the voltage value of the driving voltage VCOMH to be generated by the VCOM voltage generation section 102. The control signal Sb indicates the voltage value of the driving voltage VCOML to be generated by the VCOM voltage generation section 102.

The VCOM voltage generation section 102 generates the driving voltage VCOMH having a voltage value according to the control signal Sa output from the timing control section 101. The VCOM voltage generation section 102 generates the driving voltage VCOML having a voltage value according to the control signal Sb output from the timing control section 101.

The VCOMH operational amplifier 103H forms a voltage follower circuit, and outputs the driving voltage VCOMH generated by the VCOM voltage generation section 102. The VCOML operational amplifier 103L also forms a voltage follower circuit, and outputs the driving voltage VCOML generated by the VCOM voltage generation section 102. With the provision of the voltage follower circuits, the driving voltages VCOMH and VCOML from the VCOM voltage generation section 102 can be stably supplied to subsequent circuits (e.g., the smoothing capacitors C104-1 to C104-4).

The switch SW1 and the main-panel smoothing capacitor C104-1 are connected in series with each other between a node N104-1 and a ground node. The node N104-1 is present along a line L101H one end of which is connected to the output terminal of the VCOMH operational amplifier 103H. The switch SW1 is connected between the node N104-1 and the main-panel smoothing capacitor C104-1. The main-panel smoothing capacitor C104-1 is connected between the switch SW1 and a ground node.

The switch SW2 and the main-panel smoothing capacitor C104-2 are connected in series with each other between a node N104-2 and a ground node. The node N104-2 is present along a line L101L one end of which is connected to the output terminal of the VCOML operational amplifier 103L. The switch SW2 is connected between the node N104-2 and the main-panel smoothing capacitor C104-2. The main-panel smoothing capacitor C104-2 is connected between the switch SW2 and a ground node.

The switch SW3 and the sub-panel smoothing capacitor C104-3 are connected in series with each other between the node N104-3 and a ground node. The node N104-3 is present along the line L101H. The switch SW3 is connected between the node N104-3 and the sub-panel smoothing capacitor C104-3. The sub-panel smoothing capacitor C104-3 is connected between the switch SW3 and a ground node.

The switch SW4 and the sub-panel smoothing capacitor C104-4 are connected in series with each other between a node N104-4 and a ground node. The node N104-4 is present along the line L101L. The switch SW4 is connected between the node N104-4 and the sub-panel smoothing capacitor C104-4. The sub-panel smoothing capacitor C104-4 is connected between the switch SW4 and a ground node.

Each of the main-panel smoothing capacitors C104-1 and C104-2 and the sub-panel smoothing capacitors C104-3 and C104-4 has one end connected to a ground node, and stores an amount of charge according to the difference between the voltage value of the voltage that it receives at the other end and the voltage value at the ground node.

Each of the switches SW1 to SW4 is on when the corresponding one of the control signals S1 to S4 from the timing control section 101 is at "H level" and is off when the corresponding control signal is at "L level".

The switch SW5 is connected between a node N101H present along the line L101H and the output terminal 105M. The switch SW6 is connected between the node N101L present along the line L101L and the output terminal 105M. The switch SW7 is connected between the node N101H present along the line L101H and the output terminal 105S. The switch SW8 is connected between the node N101L present along the line L101L and the output terminal 105S.

Each of the switches SW5 to SW8 is on when the corresponding one of the control signals S5 to S8 from the timing control section 101 is at "H level" and is off when the corresponding control signal is at "L level".

The output terminal 105M supplies the potential at the node N101H (the driving voltage VCOMH) or the potential at the node N101L (the driving voltage VCOML) to the counter electrode (not shown) of the main panel. The output terminal 105S supplies the potential at the node N101H or the potential at the node N101L to the counter electrode (not shown) of the sub-panel.

The main panel includes a load capacitor C(M). The sub-panel includes a load capacitor C(S).

It is assumed herein that the main-panel smoothing capacitors C104-1 and C104-2 and the sub-panel smoothing capacitors C104-3 and C104-4 each have a capacitance value on the order of . F (microfarads), and the load capacitors C(M) and C(S) each have a capacitance value on the order of nF (nanofarads).

Internal Configuration of VCOM Voltage Generation Section 102

Figure 2:
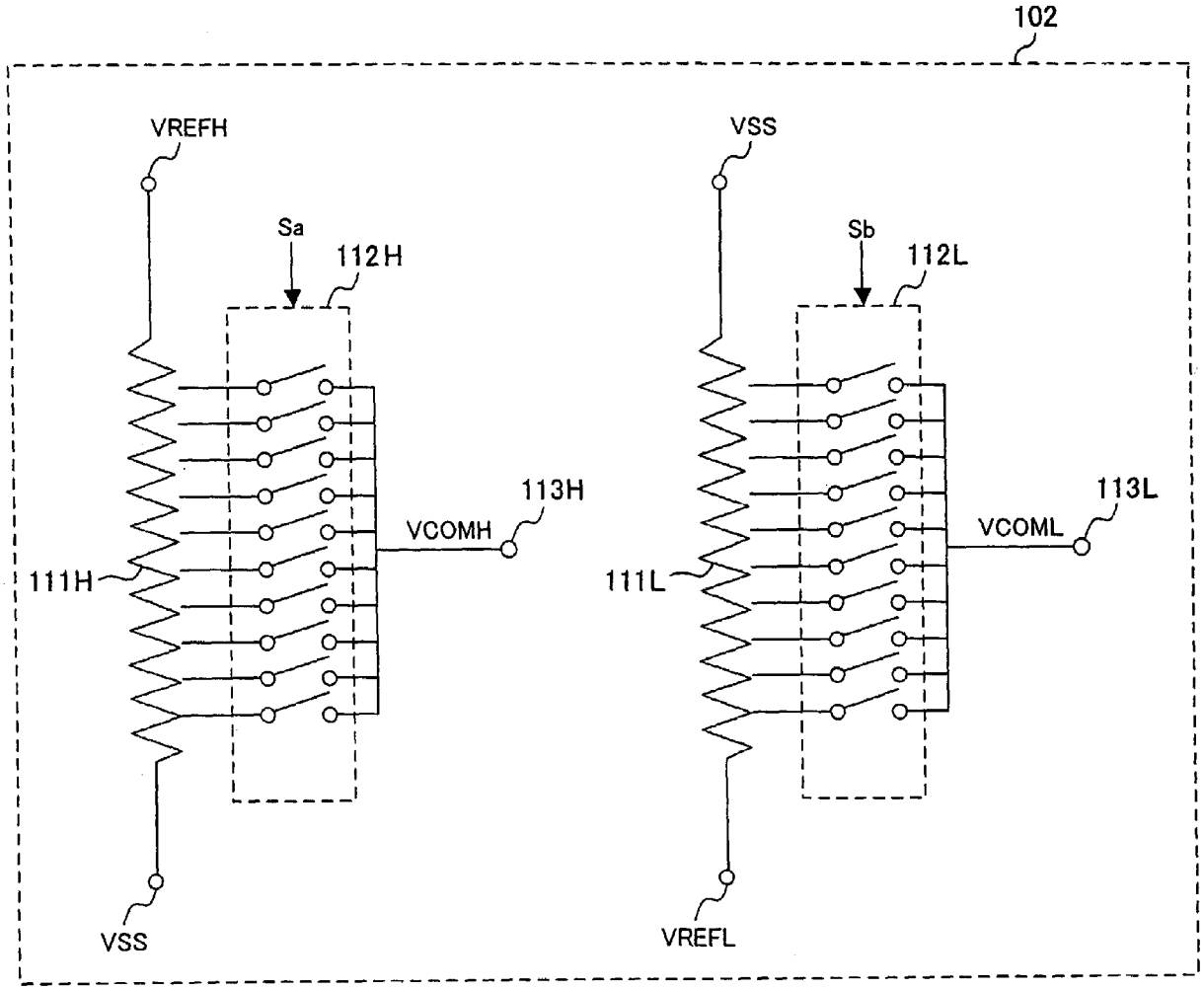
FIG. 2 shows an internal configuration of a VCOM voltage generation section 102 shown in FIG. 1.
Figure 3:
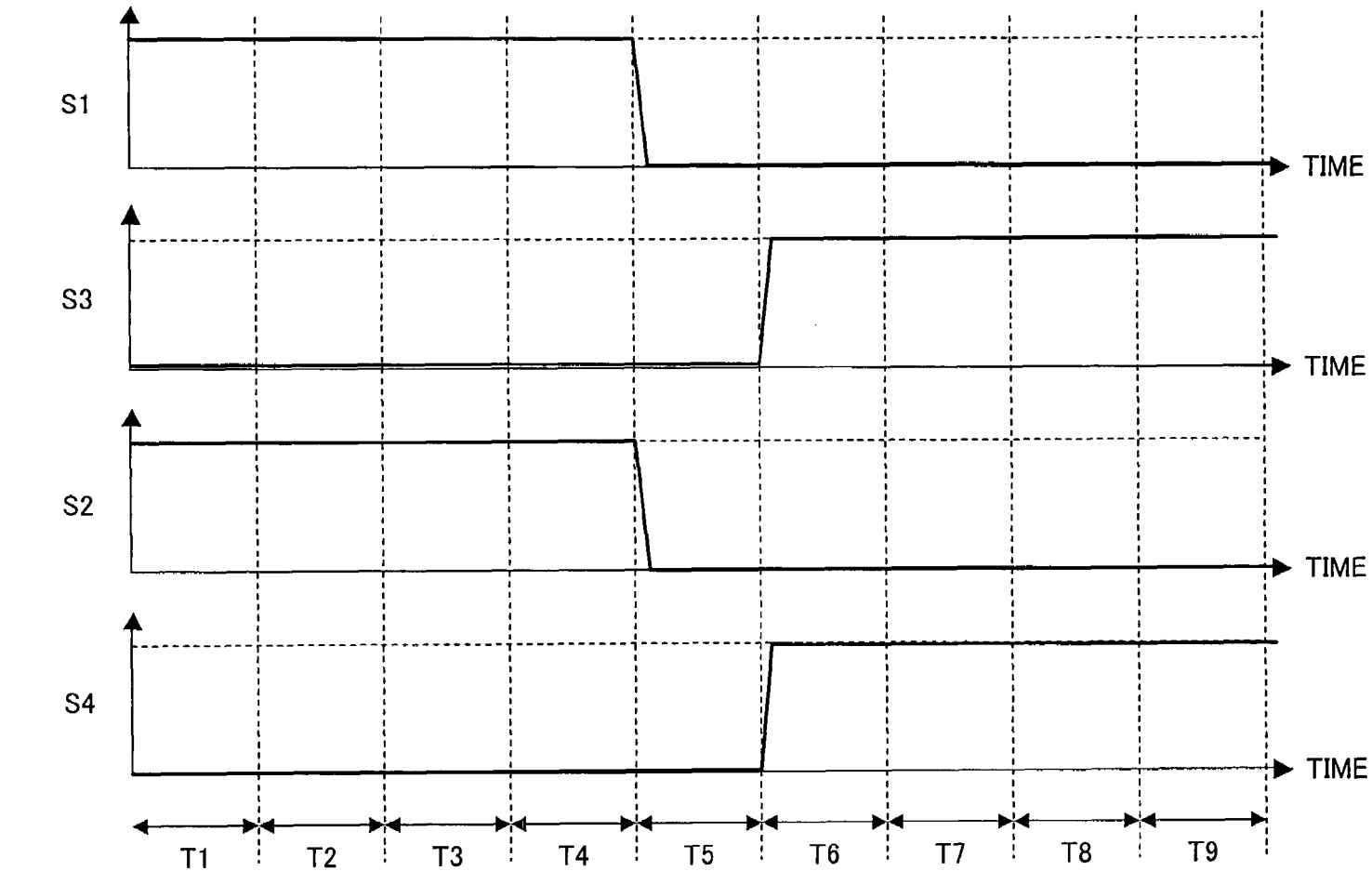
FIG. 3A to FIG. 3D are waveform diagrams of control signals S1 to S4.
Figure 4:
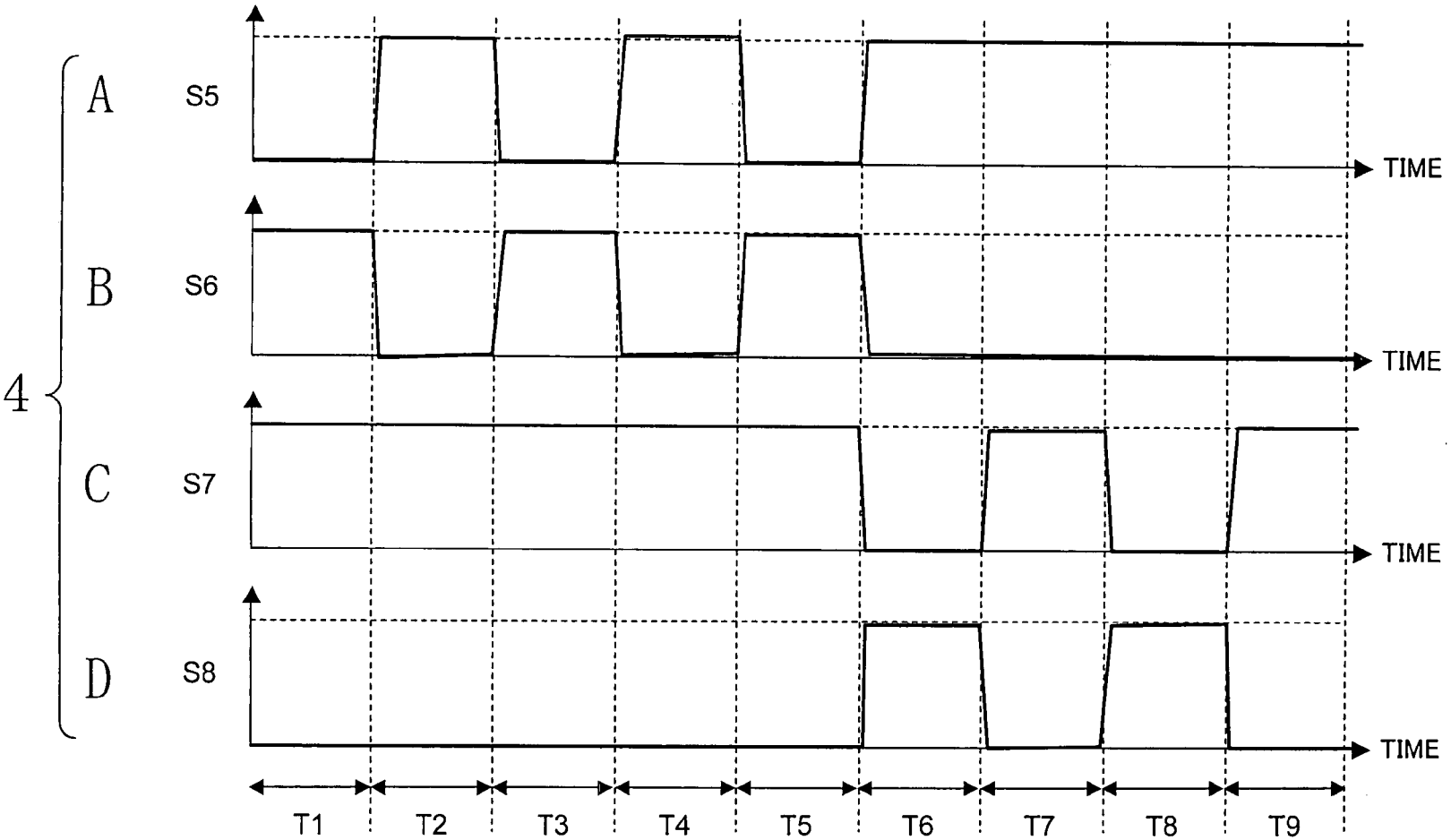
FIG. 4A to FIG. 4D are waveform diagrams of control signals S5 to S8.
Figure 5:
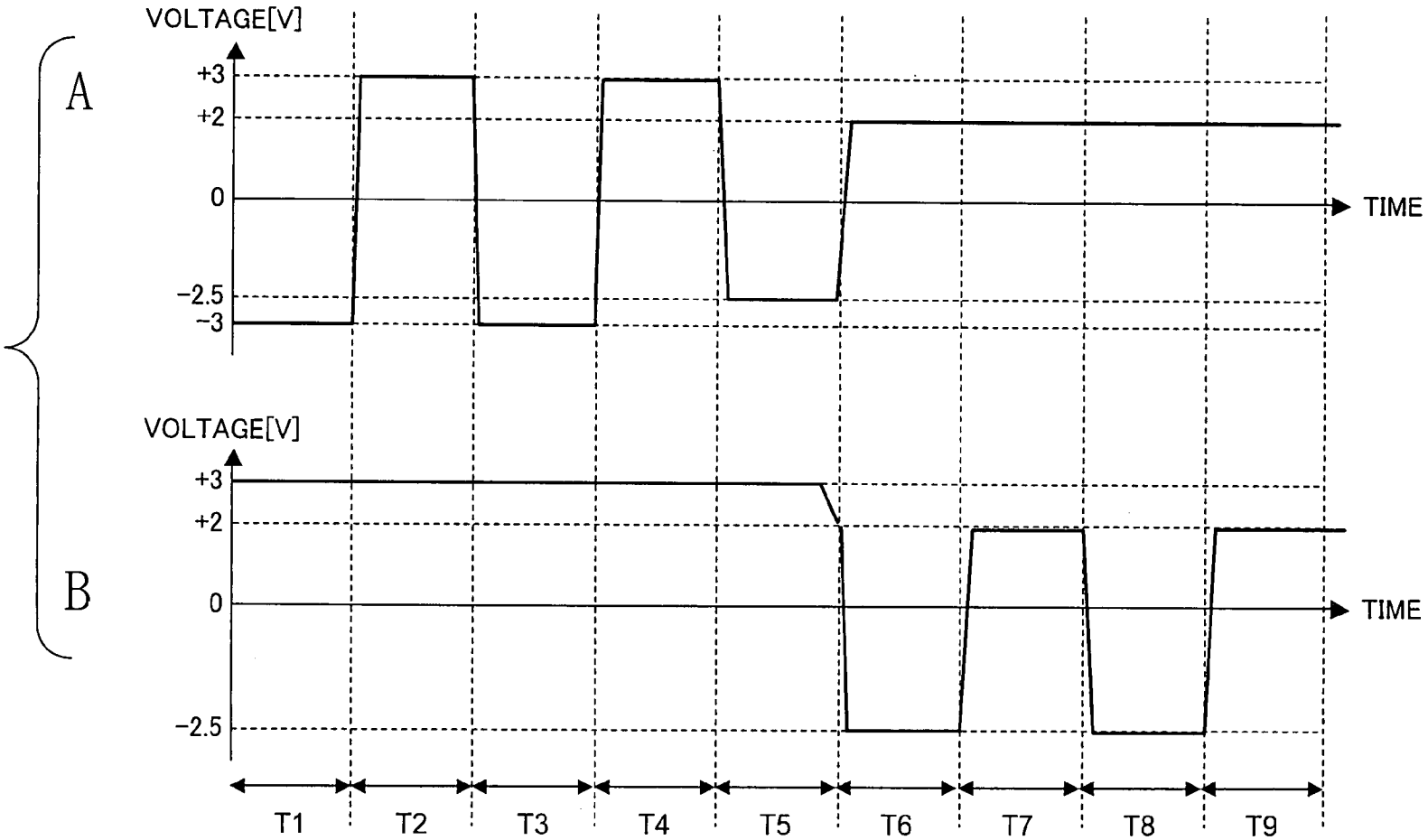
FIG. 5A is a waveform diagram of the output from an output terminal 105M.
FIG. 5B is a waveform diagram of the output from an output terminal 105S.

FIG. 2 shows an internal configuration of the VCOM voltage generation section 102 shown in FIG. 1. The VCOM voltage generation section 102 includes ladder resistors 111H and 111L, selector sections 112H and 112L and output terminals 113H and 113L.

The ladder resistor 111H, the selector section 112H and the output terminal 113H together form a so-called "RDAC (Resistance Digital Analog Converter)". The ladder resistor 111H is connected between a reference node VREFH and a reference node VSS, and generates a plurality of divided voltages by dividing the voltage between the reference node VREFH and the reference node VSS. The selector section 112H selects one of the divided voltages generated by the ladder resistor 111H. The output terminal 113H outputs the divided voltage selected by the selector section 112H as the driving voltage VCOMH.

The ladder resistor 111L, the selector section 112L and the output terminal 113L together form a so-called "RDAC". The ladder resistor 111L is connected between the reference node VSS and a reference node VREFL, and generates a plurality of divided voltages by dividing the voltage between the reference node VSS and the reference node VREFL. The selector section 112L selects one of the divided voltages generated by the ladder resistor 111L. The output terminal 113L outputs the divided voltage selected by the selector section 112L as the driving voltage VCOML.

Operation

Next, an operation of the driving voltage control device 1 shown in FIG. 1 will be described. The driving voltage control device 1 performs a main panel driving operation of controlling the driving voltages VCOMH and VCOML to be output to the counter electrode of the main panel, a sub-panel driving operation of controlling the driving voltages VCOMH and VCOML to be output to the counter electrode of the sub-panel, and a switching operation of switching between the main panel driving operation and the sub-panel driving operation.

In the illustrated example, when the timing control section 101 receives the state indicating signal STATE indicating "main panel driving operation", the timing control section 101 outputs the control signal Sa indicating a voltage value of "+3 V" and the control signal Sb indicating a voltage value of "−3 V". When the timing control section 101 receives the state indicating signal STATE indicating "sub-panel driving operation", the timing control section 101 outputs the control signal Sa indicating a voltage value of "+2 V" and the control signal Sb indicating a voltage value of "−2.5 V". It is assumed herein that the potential at the reference node VREFH is "+5 V", the potential at the reference node VSS is "0 V", and the potential at the reference node VREFL is "−5 V".

Main Panel Driving Operation

First, the main panel driving operation will be described.

When the timing control section 101 receives the state indicating signal STATE indicating "main panel driving operation", the timing control section 101 performs the switching operation and then outputs the control signals Sa and Sb to the VCOM voltage generation section 102. The control signal Sa indicates "+3 V", and the control signal Sb indicates "−3 V".

Moreover, when the timing control section 101 receives the state indicating signal STATE indicating "main panel driving operation", the timing control section 101 brings the control signals S1 and S2 to "H level" and the control signals S3 and S4 to "L level". Thus, the switches SW1 and SW2 are turned on, whereby the main-panel smoothing capacitor C104-1 is connected to the node N104-1 and the main-panel smoothing capacitor C104-2 to the node N104-2.

Moreover, when the timing control section 101 receives the state indicating signal STATE indicating "main panel driving operation", the timing control section 101 brings the control signal S7 to "H level" and the control signal S8 to "L level". Thus, the output terminal 105S is connected to the node N101H.

Then, the VCOM voltage generation section 102 generates the driving voltage VCOMH having a voltage value of "+3 V" according to the control signal Sa output from the timing control section 101. Moreover, the VCOM voltage generation section 102 generates the driving voltage VCOML having a voltage value of "−3 V" according to the control signal Sb output from the timing control section 101.

Then, the VCOMH operational amplifier 103H outputs the driving voltage VCOMH (+3 V) generated by the VCOM voltage generation section 102. Thus, the main-panel smoothing capacitor C104-1 stores an amount of charge according to the potential difference between the driving voltage VCOMH (+3 V) and the ground node (0 V). The VCOML operational amplifier 103L outputs the driving voltage VCOML (−3 V) generated by the VCOM voltage generation section 102. Thus, the main-panel smoothing capacitor C104-2 stores an amount of charge according to the potential difference between the driving voltage VCOML (−3 V) and the ground node (0 V).

Then, the timing control section 101 alternately brings the control signals S5 and S6 to "H level" according to the timing signal TIMING. Thus, the output terminal 105M alternately outputs the voltage according to the amount of charge stored in the main-panel smoothing capacitor C104-1 (the driving voltage VCOML (+3 V)) and the voltage according to the amount of charge stored in the main-panel smoothing capacitor C104-2 (the driving voltage VCOML (−3 V)) to the counter electrode (not shown) of the main panel.

Moreover, with the switch SW7 being on, the output terminal 105S is connected to the node N101H. Thus, the output terminal 105S outputs the voltage according to the amount of charge stored in the main-panel smoothing capacitor C104-1 (the driving voltage VCOML (+3 V)) to the counter electrode (not shown) of the sub-panel.

Now, the relationship between the voltage levels of the control signals S1 to S8 (the on/off states of the switches SW1 to SW8) and the outputs from the output terminals 105M and 105S during the main panel driving operation will be described with reference to FIG. 3A to FIG. 5B. During the period T1-T4, the driving voltage control device 1 performs the main panel driving operation.

During the period T1-T4, the switches SW1 and SW2 are kept on and the switches SW3 and SW4 are kept off (see FIG. 3A to FIG. 3D). Therefore, during the period T1-T4, the main-panel smoothing capacitor C104-1 remains being connected to the node N104-1, and the main-panel smoothing capacitor C104-2 remains being connected to the node N104-2. Thus, the main-pariel smoothing capacitor C104-1 stores an amount of charge according to the voltage value (+3 V) of the driving voltage VCOMH output from the VCOMH operational amplifier 103H. The main-panel smoothing capacitor C104-2 stores an amount of charge according to the voltage value (−3 V) of the driving voltage VCOML output from the VCOML operational amplifier 103L.

Moreover, during the period T1-T4, the switches SW6 and SW5 are turned on/off at intervals of one time segment (see FIG. 4A and FIG. 4B). Thus, the output terminal 105M outputs the voltage according to the amount of charge stored in the main-panel smoothing capacitor C104-2 (the driving voltage VCOMH (−3 V)) and the voltage according to the amount of charge stored in the main-panel smoothing capacitor C104-1 (the driving voltage VCOML (+3 V)) alternately at intervals of one time segment (see FIG. 5A).

Moreover, during the period T1-T4, the switch SW7 is kept on (see FIG. 4C). Thus, the output terminal 105S remains outputting the voltage according to the amount of charge stored in the main-panel smoothing capacitor C104-1 (the driving voltage VCOMH (+3 V)) (see FIG. 5B).

As described above, in the main panel driving operation, the main-panel smoothing capacitors C104-1 and C104-2 are used, whereby the driving voltages VCOMH (+3 V) and VCOML (−3 V) having suitable voltage values for the main panel can be supplied to the main panel.

Sub-Panel Driving Operation

Next, the sub-panel driving operation will be described.

When the timing control section 101 receives the state indicating signal STATE indicating "sub-panel driving operation", the timing control section 101 outputs the control signals Sa and Sb to the VCOM voltage generation section 102. The control signal Sa indicates "+2 V", and the control signal Sb indicates "−2.5 V".

Moreover, when the timing control section 101 receives the state indicating signal STATE indicating "sub-panel driving operation", the timing control section 101 brings the control signals S1 and S2 to "L level" and the control signals S3 and S4 to "H level". Thus, the switches SW3 and SW4 are turned on, whereby the sub-panel smoothing capacitor C104-3 is connected to the node N104-3 and the sub-panel smoothing capacitor C104-4 to the node N104-4.

Moreover, when the timing control section 101 receives the state indicating signal STATE indicating "sub-panel driving operation", the timing control section 101 brings the control signal S5 to "H level" and the control signal S6 to "L level". Thus, the output terminal 105M is connected to the node N101H.

Then, the VCOM voltage generation section 102 generates the driving voltage VCOMH having a voltage value of "+2 V" according to the control signal Sa output from the timing control section 101. Moreover, the VCOM voltage generation section 102 generates the driving voltage VCOML having a voltage value of "−2.5 V" according to the control signal Sb output from the timing control section 101.

Then, the VCOMH operational amplifier 103H outputs the driving voltage VCOMH (+2 V) generated by the VCOM voltage generation section 102. Thus, the sub-panel smoothing capacitor C104-3 stores an amount of charge according to the potential difference between the driving voltage VCOMH (+2 V) and the ground node (0 V). The VCOML operational amplifier 103L outputs the driving voltage VCOML (−2.5 V) generated by the VCOM voltage generation section 102. Thus, the sub-panel smoothing capacitor C104-4 stores an amount of charge according to the potential difference between the driving voltage VCOML (−2.5 V) and the ground node (0 V).

Then, the timing control section 101 alternately brings the control signals S7 and S8 to "H level" according to the timing signal TIMING. Thus, the output terminal 105S alternately outputs the voltage according to the amount of charge stored in the sub-panel smoothing capacitor C104-3 (the driving voltage VCOMH (+2 V)) and the voltage according to the amount of charge stored in the sub-panel smoothing capacitor C104-4 (the driving voltage VCOML (−2.5 V)) to the counter electrode (not shown) of the sub-panel.

Moreover, with the switch SW5 being on, the output terminal 105M is connected to the node N101H. Thus, the output terminal 105M outputs the voltage according to the amount of charge stored in the sub-panel smoothing capacitor C104-3 (the driving voltage VCOMH (+2 V)) to the counter electrode (not shown) of the main panel.

Now, the relationship between the voltage levels of the control signals S1 to S8 (the on/off states of the switches SW1 to SW8) and the outputs from the output terminals 105M and 105S during the sub-panel driving operation will be described with reference to FIG. 3A to FIG. 5B. During the period T6-T9, the driving voltage control device 1 performs the sub-panel driving operation.

During the period T6-T9, the switches SW1 and SW2 are kept off and the switches SW3 and SW4 are kept on (see FIG. 3A to FIG. 3D). Therefore, during the period T6-T9, the sub-panel smoothing capacitor C104-3 remains being connected to the node N104-3, and the sub-panel smoothing capacitor C104-4 remains being connected to the node N104-4. Thus, the sub-panel smoothing capacitor C104-3 stores an amount of charge according to the driving voltage VCOMH (+2 V) output from the VCOMH operational amplifier 103H. The sub-panel smoothing capacitor C104-4 stores an amount of charge according to the driving voltage VCOML (−2.5 V) output from the VCOML operational amplifier 103L.

Moreover, during the period T6-T9, the switches SW8 and SW7 are turned on/off at intervals of one time segment (see FIG. 4C and FIG. 4D). Thus, the output terminal 105S outputs the voltage according to the amount of charge stored in the sub-panel smoothing capacitor C104-4 (the driving voltage VCOMH (−2.5 V)) and the voltage according to the amount of charge stored in the sub-panel smoothing capacitor C104-3 (the driving voltage VCOML (+2 V)) alternately at intervals of one time segment (see FIG. 5B).

Moreover, during the period T6-T9, the switch SW5 is kept on (see FIG. 4A). Thus, the output terminal 105M remains outputting the voltage according to the amount of charge stored in the sub-panel smoothing capacitor C104-3 (the driving voltage VCOMH (+2 V)) (see FIG. 5A).

As described above, in the sub-panel driving operation, the sub-panel smoothing capacitors C104-3 and C104-4 are used, whereby the driving voltages VCOMH (+2 V) and VCOML (−2.5 V) having suitable voltage values for the sub-panel can be supplied to the sub-panel.

Switching Operation

Next, the switching operation will be described.

First, assume that the driving voltage control device 1 is currently performing the main panel driving operation. In this case, the timing control section 101 is keeping the control signals S1, S2 and S7 at "H level" and the control signals S3, S4 and S8 at "L level". Moreover, the timing control section 101 alternately brings the control signals S1 and S2 to "H level" according to the timing signal TIMING (the period T1-T4 in FIG. 3A to FIG. 4D).

Then, if the timing control section 101 receives the state indicating signal STATE indicating "sub-panel driving operation", the timing control section 101 brings the control signals S1 to S4 to "L level" (see the period T5 in FIG. 3A to FIG. 3D). Thus, the main-panel smoothing capacitors C104-1 and C104-2 and the sub-panel smoothing capacitors C104-3 and C104-4 are all disconnected (isolated) from their respective nodes.

Then, the timing control section 101 outputs the control signals Sa and Sb to the VCOM voltage generation section 102 according to the state indicating signal STATE. Thus, the VCOM voltage generation section 102 changes the voltage value of the driving voltage VCOMH from "+3 V" to "+2 V", and the voltage value of the driving voltage VCOML from "−3 V" to "−2.5 V".

As the VCOM voltage generation section 102 generates the driving voltage VCOMH having a voltage value of "+2 V" and the driving voltage VCOML having a voltage value of "−2.5 V", the sub-panel driving operation is performed. Specifically, the timing control section 101 brings the control signals S3 and S4 to "H level" (see the period T6-T9 in FIG. 3A to FIG. 3D). Thus, the sub-panel smoothing capacitors C104-3 and C104-4 are connected to the nodes N104-3 and N104-4, respectively, the sub-panel smoothing capacitor C104-3 stores an amount of charge according to the voltage value of the driving voltage VCOMH (+2 V) output from the VCOMH operational amplifier 103H, and the sub-panel smoothing capacitor C104-4 stores an amount of charge according to the voltage value of the driving voltage VCOML (−2.5 V) output from the VCOML operational amplifier 103L.

Moreover, the timing control section 101 brings the control signal S5 to "H level" and the control signal S6 to "L level", and alternately brings the control signals S3 and S4 to "H level" according to the timing signal TIMING (see the period T6-T9 in FIG. 4A to FIG. 4D).

Thereafter, the sub-panel driving operation as described above is performed.

Now, the relationship between the voltage levels of the control signals S1 to S8 (the on/off states of the switches SW1 to SW8) and the outputs from the output terminals 105M and 105S during the switching operation will be described with reference to FIG. 3A to FIG. 5B. The driving voltage control device 1 performs the switching operation in the period T5.

During the period T5, the switches SW1 to SW4 are kept off (see FIG. 3A to FIG. 3D). Therefore, the main-panel smoothing capacitor C104-1 is disconnected from the node N104-1 with an amount of charge according to the voltage value (+3 V) of the driving voltage VCOMH being stored therein. Moreover, the main-panel smoothing capacitor C104-2 is disconnected from the node N104-2 with an amount of charge according to the voltage value (−3 V) of the driving voltage VCOML being stored therein.

During the period T5, the switch SW7 is on (see FIG. 4C). Since the voltage value of the driving voltage VCOMH output from the VCOMH operational amplifier 103H is changed from "+3 V" to "+2 V", the potential at the node N101H transitions from "+3 V" to "+2 V". Thus, the output from the output terminal 105S transitions from "+3 V" to "+2 V" (see FIG. 5B).

Moreover, during the period T5, the switch SW6 is on and the switch SW5 is off. Since the voltage value of the driving voltage VCOMH output from the VCOMH operational amplifier 103H is changed from "+3 V" to "+2 V", the potential at the node N101H transitions from "+3 V" to "+2 V". Thus, the output from the output terminal 105M transitions from "+3 V" to "+2 V" (see FIG. 5A).

A similar operation is performed when the driving voltage control device 1 switches from the sub-panel driving operation to the main panel driving operation. Specifically, as the timing control section 101 brings the control signals S1 to S4 to "L level", the sub-panel smoothing capacitor C104-3 is disconnected from the node N104-3 with an amount of charge according to the voltage value (+2 V) of the driving voltage VCOMH being stored therein, and the sub-panel smoothing capacitor C104-4 is disconnected from the node N104-4 with an amount of charge according to the voltage value (−2.5 V) of the driving voltage VCOML being stored therein.

The period by which the main-panel driving operation and the sub-panel driving operation are switched from one to another (the inversion period) can be determined based on the type of liquid crystal display panels and the panel driving method to be used. For example, where the driving method is a "frame inversion driving method", the inversion period is "1/60 Hz (=16.67 ms)", and where the driving method is an "N-line inversion driving method (N is a natural number), the inversion period is "(1/60 Hz)×(1/(number of lines))×N" (e.g., the inversion period is "52.08·s" if the number of lines is 320 and 1-line inversion driving method).

Effects

As described above, since the main-panel smoothing capacitors C104-1 and C104-2 and the sub-panel smoothing capacitors C104-3 and C104-4 are disconnected from the corresponding nodes during the switching period (period T5), the smoothing capacitors C104-1 to C104-4 are not charged/discharged during this period. Thus, it is possible to prevent the charge from being wasted.

During the switching period (period T5), what is charged/discharged by the VCOMH operational amplifier 103H and the VCOML operational amplifier 103L is the liquid crystal display element present in each display panel (the load capacitors C(M) and C(S) in FIG. 1). The capacitance values of the display panel load capacitors C(M) and C(S) are significantly smaller than those of the main-panel smoothing capacitors C104-1 and C104-2 and the sub-panel smoothing capacitors C104-3 and C104-4 of the driving voltage control device 1. Therefore, it is possible to more quickly switch between units to be driven (i.e., to shorten the length of the period T5) without increasing the driving power of the VCOMH operational amplifier 103H and the VCOML operational amplifier 103L.

Moreover, the driving voltage control device 1 fixes the potential of the counter electrode of the display panel not being driven by the driving voltage VCOMH. By fixing the potential of the counter electrode of the liquid crystal display panel by a DC voltage (the driving voltage VCOMH in the present embodiment), it is possible to reduce the visual unnaturalness on the display panel not being driven.

While the time segments T1 to T9 are equal in length in FIG. 3A to FIG. 5B, the present invention is not limited to this.

Moreover, the internal configuration of the VCOM voltage generation section 102 is not limited to that shown in FIG. 2. For example, a ladder resistor may be connected between the reference node VREFH and the reference node VREFL, while providing a selector section for selecting two of the divided voltages generated by the ladder resistor. In such a case, the two divided voltages selected by the selector section may be output as the driving voltages VCOMH and VCOML.

Moreover, while the potential of the counter electrode of the display panel not being driven is fixed by the driving voltage VCOMH in the present embodiment, similar effects can be obtained also when the potential of the counter electrode of the display panel not being driven is fixed by the driving voltage VCOML. In such a case, the switch SW8, instead of the switch SW7, may be turned on in the main panel driving operation. Similarly, the switch SW6, instead of the switch SW5, may be turned on in the sub-panel driving operation.

Second Embodiment

With the driving voltage control device 1 shown in FIG. 1, during the period in which the main panel is driven by an AC driving method (the period T1-T4 in FIG. 3A to FIG.

5B), the potential of the counter electrode of the sub-panel is fixed to the voltage value (+3 V) of the driving voltage VCOMH by turning on the switch SW7. During the period in which the sub-panel is driven by an AC driving method (the period T6-T9 in FIG. 3A to FIG. 5B), the potential of the counter electrode of the sub-panel varies from the voltage value (+2 V) of the driving voltage VCOMH to the voltage value (−2.5 V) of the driving voltage VCOML. Thus, a voltage suitable for the sub-panel is not applied to the sub-panel when it is not driven (i.e., when the sub-panel is not lit), whereby some visual unnaturalness may be perceived on the sub-panel.

Moreover, where the voltage value of the driving voltage by which the potential of the counter electrode of the display panel not being driven is fixed is larger than the voltage value of the driving voltage applied to the counter electrode of the display panel when it is driven, the display panel may be broken. Therefore, the voltage resistance of the display panel needs to be increased.

General Configuration

Figure 6:
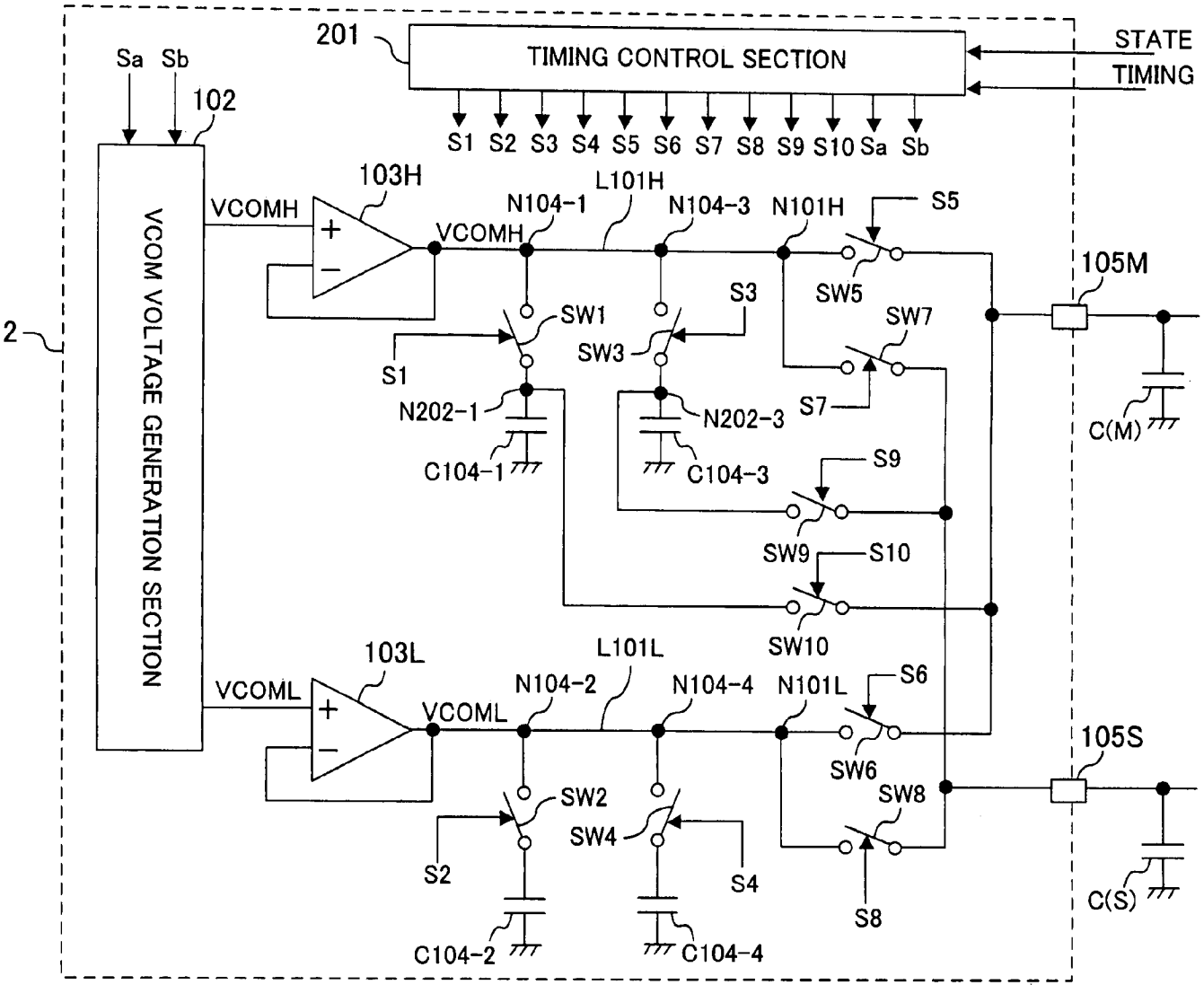
FIG. 6 shows a general configuration of a driving voltage control device according to a second embodiment of the present invention.

FIG. 6 shows a general configuration of a driving voltage control device 2 according to a second embodiment of the present invention. The device 2 includes a timing control section 201, instead of the timing control section 101 shown in FIG. 1, and additionally includes switches SW9 and SW10. Other than this, the configuration is similar to that shown in FIG. 1.

As does the timing control section 101, the timing control section 201 receives the state indicating signal STATE and the switching timing signal TIMING from outside, and outputs the control signals Sa, Sb and S1 to S8. The control signals Sa, Sb and S1 to S8 are as shown in FIG. 1. Moreover, when the timing control section 201 receives the state indicating signal STATE from outside, the timing control section 201 outputs control signals S9 and S10.

The switch SW9 is connected between the output terminal 105S and an interconnection node N202-3 (a node between the switch SW3 and the sub-panel smoothing capacitor C104-3). The switch SW10 is connected between the output terminal 105M and an interconnection node N202-1 (a node between the switch SW1 and the main-panel smoothing capacitor C104-1).

The switches SW9 and SW10 are on when the control signals S9 and S10, respectively, from the timing control section 201 are at "H level", and off when they are at "L level".

Operation

Next, an operation of the driving voltage control device 2 shown in FIG. 6 will be described. The operation of the device 2 is similar to that of the driving voltage control device 1 shown in FIG. 1 except for the operation of the timing control section 901 and those of the switches SW9 and SW10.

Main Panel Driving Operation

Figure 7:
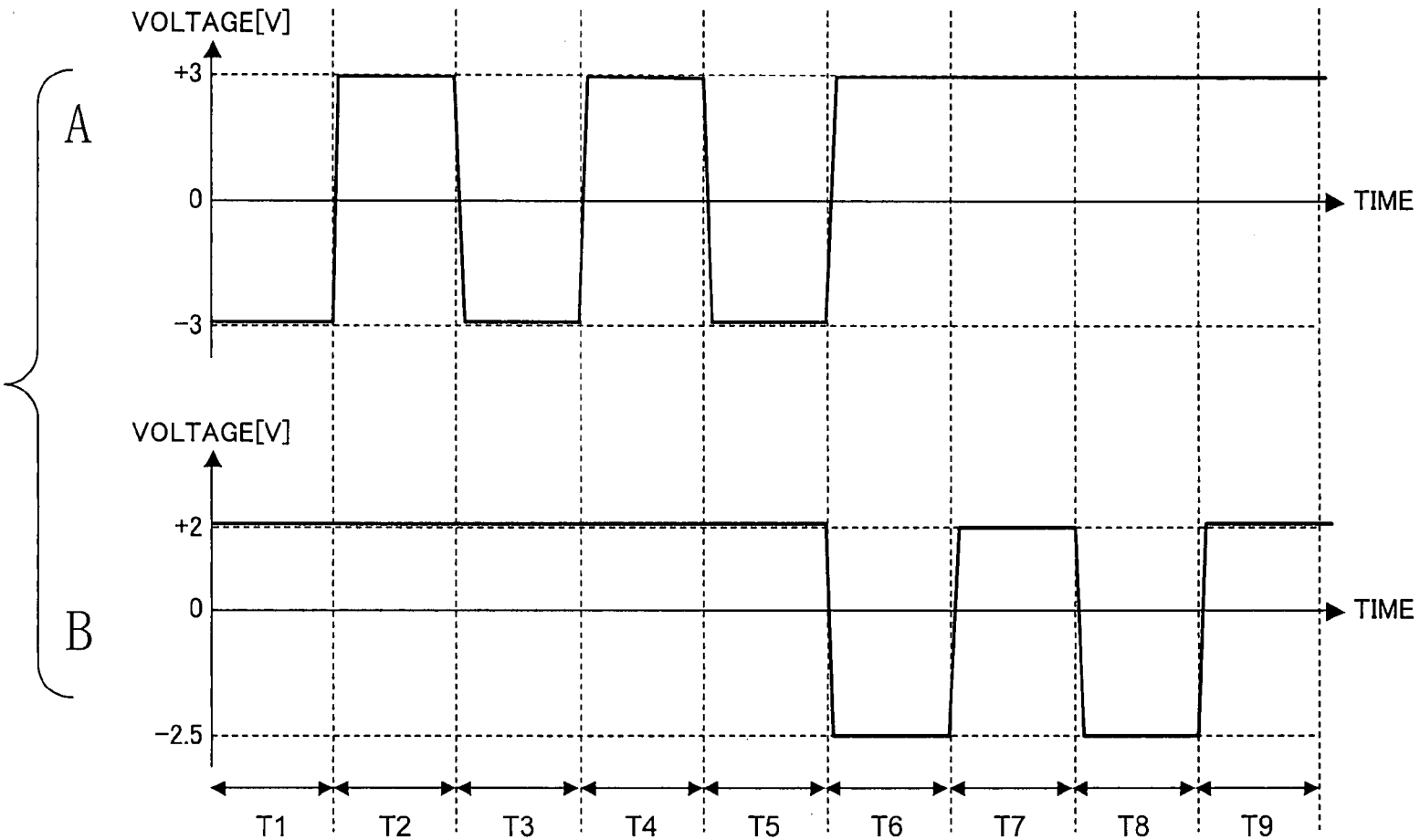
FIG. 7A is a waveform diagram of the output from the output terminal 105M.
FIG. 7B is a waveform diagram of the output from the output terminal 105S.

When the timing control section 201 receives the state indicating signal STATE indicating "main panel driving operation", the timing control section 201 brings the control signal S9 to "H level" and the control signal S10 to "L level". Thus, the output terminal 105S is connected to the node N202-3. The sub-panel smoothing capacitor C104-3 has an amount of charge according to the voltage value (+2 V) of the driving voltage VCOMH. Therefore, the output terminal 105S outputs the voltage according to the amount of charge stored in the sub-panel smoothing capacitor C104-3 (the driving voltage VCOMH (+2 V)). Thus, during the period T1-T4, the output from the output terminal 105S is as shown in FIG. 7B.

Sub-Panel Driving Operation

When the timing control section 201 receives the state indicating signal STATE indicating "sub-panel driving operation", the timing control section 201 brings the control signal S9 to "L level" and the control signal S10 to "H level". Thus, the output terminal 105M is connected to the node N202-1. The main-panel smoothing capacitor C104-1 has an amount of charge according to the voltage value (+3 V) of the driving voltage VCOMH. Therefore, the output terminal 105M outputs the voltage according to the amount of charge stored in the main-panel smoothing capacitor C104-1 (the driving voltage VCOMH (+3 V)). Thus, during the period T6-T9, the output from the output terminal 105M is as shown in FIG. 7A.

Effects

As described above, the potential of the counter electrode of the main panel not being driven is fixed by the voltage value of the driving voltage VCOMH, which is applied to the panel when it is driven. Moreover, the potential of the counter electrode of the sub-panel not being driven is fixed by the voltage value of the driving voltage VCOMH, which is applied to the panel when it is driven. Thus, the potential of the counter electrode of the liquid crystal display panel not being driven is fixed by the voltage (the driving voltage VCOMH) suitable for the liquid crystal display panel. Therefore, it is possible to reduce the visual unnaturalness.

Moreover, as the voltage value of the driving voltage by which the potential of the counter electrode of the display panel not being driven is fixed is less than or equal to the voltage value of the driving voltage applied to the counter electrode of the display panel when it is driven, the voltage resistance of the liquid crystal display panel does not need to be increased.

Similar effects can be obtained also when the potential of the counter electrode of the liquid crystal display panel not being driven is fixed by the driving voltage VCOML, which is applied to the counter electrode of the liquid crystal display panel when it is driven.

Variation

Figure 8:
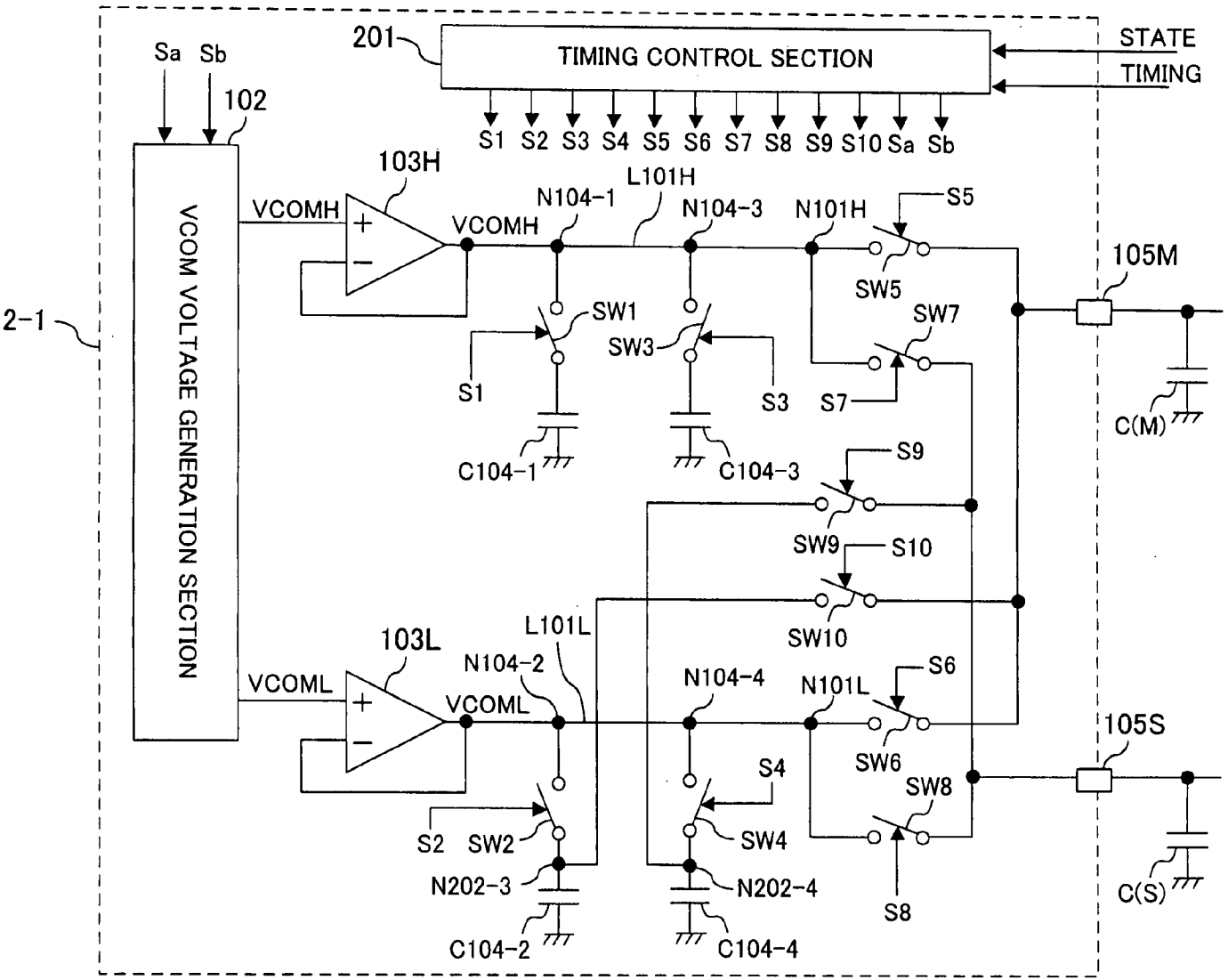
FIG. 8 shows a general configuration of a driving voltage control device according to a variation of the second embodiment of the present invention.

FIG. 8 shows a driving voltage control device 2-1 according to the second embodiment of the present invention. In the device 2-1, how the switches SW9 and SW10 are connected is different from that in the device 2 shown in FIG. 6. Other than this, the configuration is similar to that shown in FIG. 6.

The switch SW9 is connected between the output terminal 105S and an interconnection node N202-4 (a node between the switch SW4 and the sub-panel smoothing capacitor C104-4). The switch SW10 is connected between the output terminal 105M and an interconnection node N202-2 (a node between the switch SW2 and the main-panel smoothing capacitor C104-2).

Next, an operation of the driving voltage control device 2-1 shown in FIG. 8 will be described.

Main Panel Driving Operation

Moreover, when the timing control section 201 receives the state indicating signal STATE indicating "main panel driving operation", the timing control section 201 brings the control signal S9 to "H level" and the control signal S10 to "L level". Thus, the output terminal 105S is connected to the node N202-4. The sub-panel smoothing capacitor C104-4 has an amount of charge according to the voltage value (−2.5 V) of the driving voltage VCOML. Therefore, the output terminal 105S outputs the voltage according to the amount of charge stored in the sub-panel smoothing capacitor C104-4 (the driving voltage VCOML (−2.5 V)).

Sub-Panel Driving Operation

When the timing control section 201 receives the state indicating signal STATE indicating "sub-panel driving operation", the timing control section 201 brings the control signals S9 to "L level" and the control signal S10 to "H level". Thus, the output terminal 105M is connected to the node N202-2. The main-panel smoothing capacitor C104-2 has an amount of charge according to the voltage value (−3 V) of the driving voltage VCOML. Therefore, the output terminal 105M outputs the voltage according to the amount of charge stored in the main-panel smoothing capacitor C104-2 (the driving voltage VCOML (+3 V)).

As described above, the potential of the counter electrode of the liquid crystal display panel not being driven is fixed by the driving voltage VCOML, which is applied to the counter electrode of the liquid crystal display panel when it is driven.

Third Embodiment

General Configuration

Figure 9:
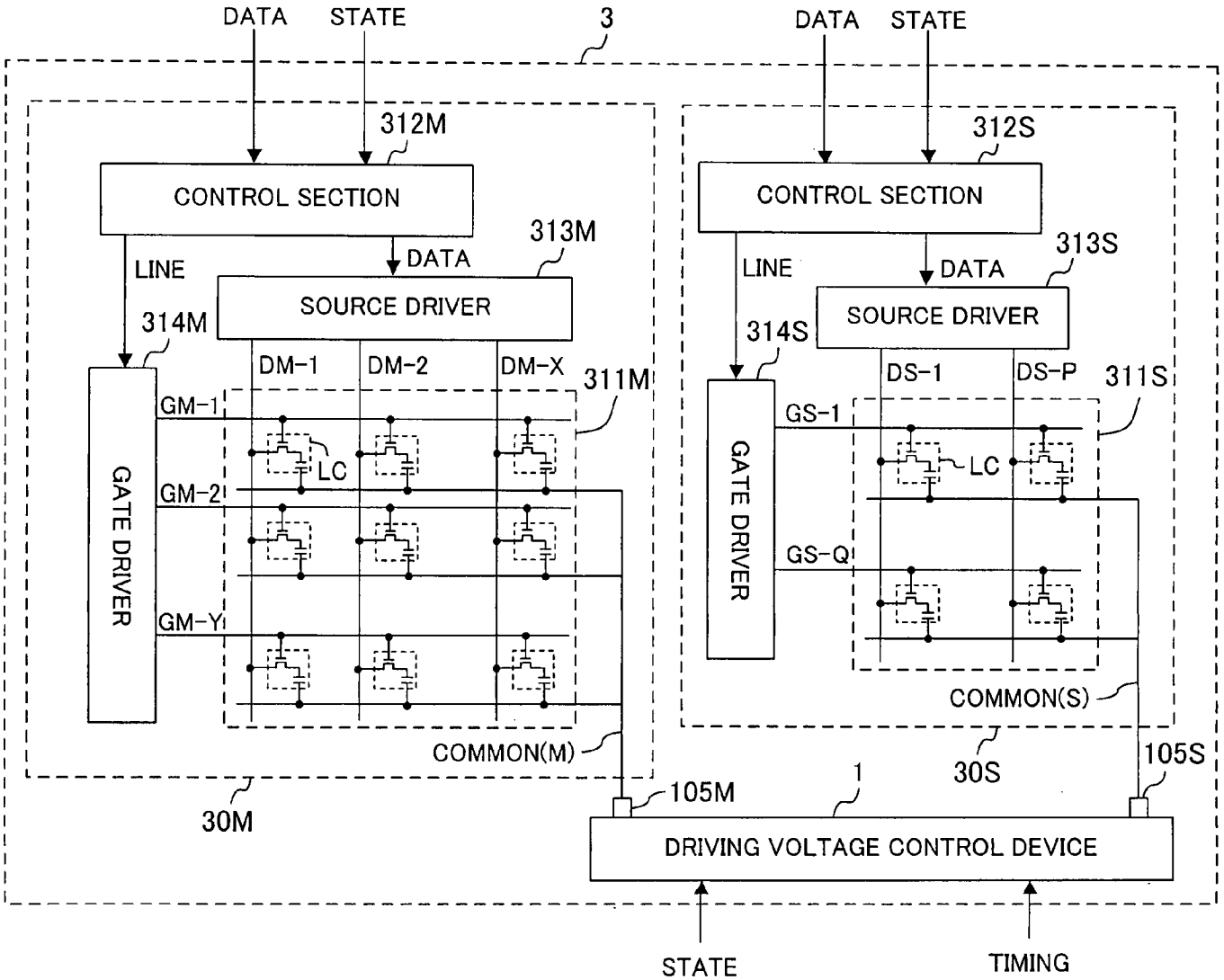
FIG. 9 shows a general configuration of a display device according to a third embodiment of the present invention.
Figure 10:
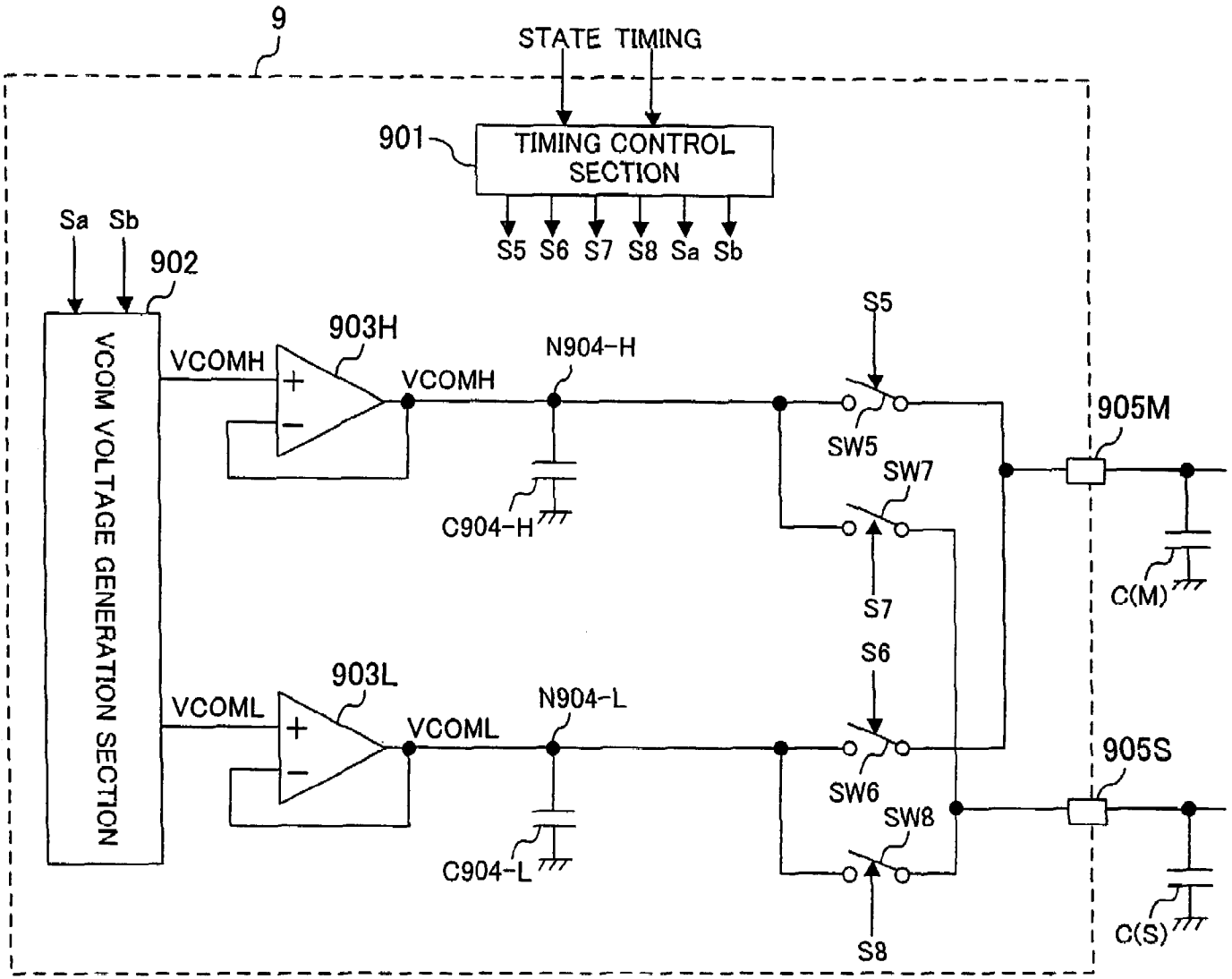
FIG. 10 shows a general configuration of a conventional driving voltage control device.
Figure 11:
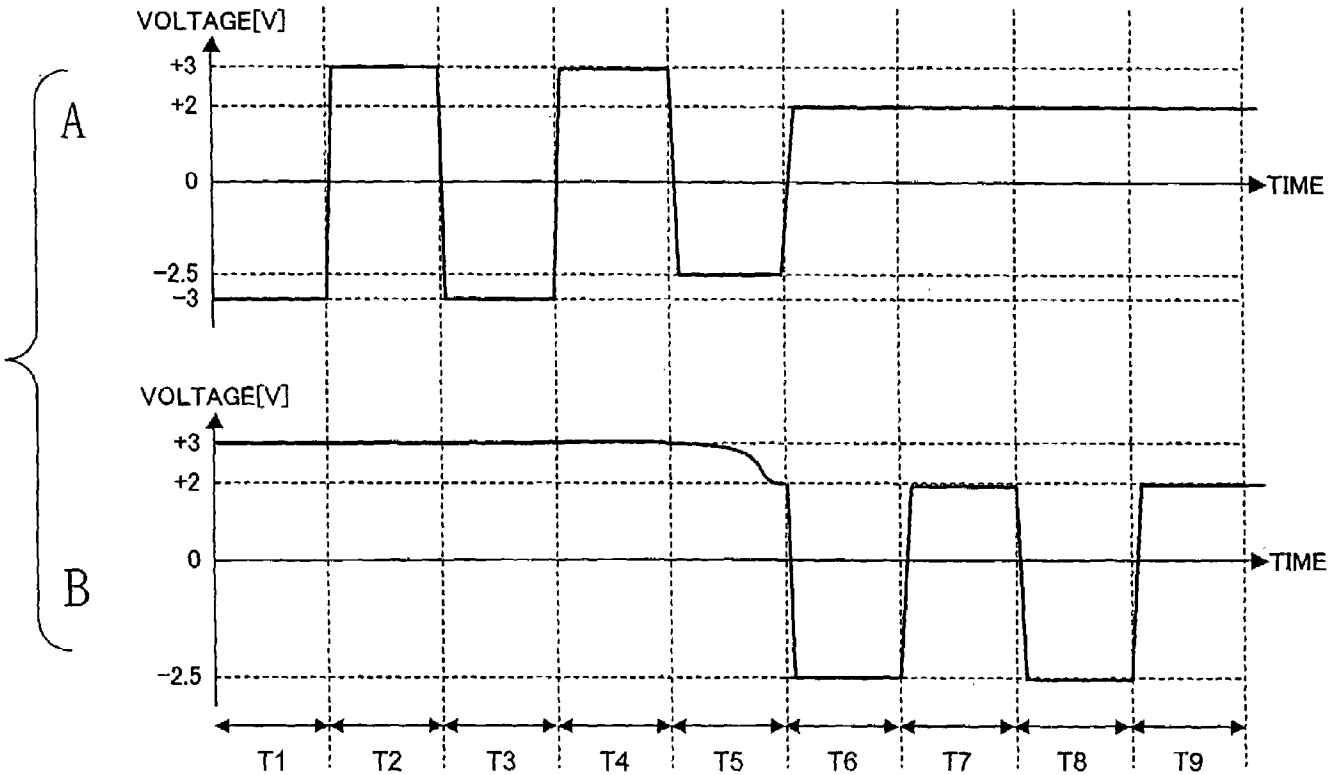
FIG. 11A is a waveform diagram of the output from an output terminal 905M.
FIG. 11B is a waveform diagram of the output from an output terminal 905S.

FIG. 9 shows a general configuration of a display device 3 according to a third embodiment of the present invention. The device 3 includes a main panel driving device 30M, a sub-panel driving device 30S, and the driving voltage control device 1 shown in FIG. 1.

Main Panel Driving Device 30M

The main panel driving device 30M shown in FIG. 9 includes a main panel 311M, a control section 312M, a source driver 313M and a gate driver 314M. The main panel driving device 30M drives the display panel 311M by a so-called "active matrix driving method".

The main panel 311M includes a number X (X is a natural number) of data lines DM-1 to DM-X, a number Y (Y is a natural number) of gate lines GM-1 to GM-Y, a counter electrode COMMON(M), and a number (XxY) of liquid crystal display circuits LC arranged in a matrix pattern. Each liquid crystal display circuit LC includes a switching element (e.g., a TFT (thin film transistor)) and a liquid crystal display element.

The control section 312M operates as it receives the state indicating signal STATE indicating "main panel driving operation". The control section 312M outputs display data DATA to the source driver 313M. Moreover, the control section 312M outputs a scanning control signal LINE to the gate driver 314M. The display data DATA represents a gray level.

The source driver 313M supplies a data signal having a voltage value according to the display data DATA output from the control section 312M to the data lines DM-1 to DM-X of the main panel 311M.

The gate driver 314M supplies a gate signal according to the scanning control signal LINE output from the control section 312M to the gate lines GM-1 to GM-Y of the main panel 311M.

The switching element included in each liquid crystal display circuit LC is activated when the gate signal is applied to a gate line that corresponds to the liquid crystal display circuit LC. Then, the liquid crystal display element of that liquid crystal display circuit LC receives the data signal supplied to a data line that corresponds to the liquid crystal display circuit LC. Moreover, the liquid crystal display element included in that liquid crystal display circuit LC receives the driving voltage VCOMH (or VCOML) supplied to the counter electrode COMMON(M). Therefore, the liquid crystal display element represents a level of transmittance according to the difference between the voltage value of the data signal applied to the data line and the voltage value of the driving voltage VCOMH (or VCOML) applied to the counter electrode.

Thus, the main panel driving device 30M is driven by an AC driving method (line inversion driving method) in order to prevent the burn-in of the liquid crystal display elements formed in the display panel 311M.

Sub-Panel Driving Device 30S

The sub-panel driving device 30S shown in FIG. 9 has a similar configuration to that of the main panel driving device 30M shown in FIG. 9, and includes a sub-panel 311S, a control section 312S, a source driver 313S and a gate driver 314S. In the illustrated example, the sub-panel 311S includes a number P (P is a natural number, and P<X) of data lines DS-1 to DS-P, a number Q (Q is a natural number, and Q<Y) of gate lines GS-1 to GS-Q, a counter electrode COMMON(S), and a number (PxQ) of liquid crystal display circuits LC arranged in a matrix pattern. The control section 312S operates as it receives the state indicating signal STATE indicating "sub-panel driving operation".

Operation

Next, an operation of the display device 3 shown in FIG. 9 will be described.

Main Panel Driving Operation

When the control section 312M receives the state indicating signal STATE indicating "main panel driving operation", the control section 312M outputs the display data DATA to the source driver 313M and the scanning control signal LINE to the gate driver 314M. During this operation, the control section 312S is not operating.

The source driver 313M supplies a data signal to the data lines DM-1 to DM-X according to the display data DATA output from the control section 312M.

The driving voltage control device 1 alternately outputs the driving voltage VCOMH (+3 V) and the driving voltage VCOML (−3 V) to the counter electrode COMMON(M) of the display panel 311M according to the timing signal TIMING.

Sub-Panel Driving Operation

When the control section 312S receives the state indicating signal STATE indicating "sub-panel driving operation", the control section 312S outputs the display data DATA to the source driver 313S and the scanning control signal LINE to the gate driver 314S. During this operation, the control section 312M is not operating.

The operation of the source driver 313S is similar to that of the source driver 313M.

The driving voltage control device 1 alternately outputs the driving voltage VCOMH (+2 V) and the driving voltage VCOML (−2.5 V) to the counter electrode COMMON(S) of the display panel 311S according to the timing signal TIMING.

Effects

As described above, two display panels can be driven with one driving voltage control device, whereby it is possible to reduce the overall circuit scale of the display device. Moreover, the driving voltage control device 1 is capable of reducing the amount of charge to be wasted, whereby it is possible to reduce the overall power consumption of the display device. Furthermore, the driving voltage control device 1 is capable of quickly performing the mode switching operation, whereby it is possible to quickly drive each of the liquid crystal display panels 311M and 311S.

Similar effects can be obtained by using the driving voltage control devices 2 and 2-1 shown in FIG. 6 and FIG. 8, instead of the driving voltage control device 1.

While the embodiments above are directed to a case where the main panel and the sub-panel of a mobile telephone are commonly driven by an AC driving method, the present invention is not limited thereto. The present invention can be applied to devices other than mobile telephones.

Moreover, with the driving voltage control device of the present invention, it is possible to supply different sets of driving voltages VCOMH and VCOML to three liquid crystal display panel s. Specifically, a three-panel configuration can be realized by adding, to the configuration shown in FIG. 1, an additional output terminal (similar to the output terminal 105M (or 105S) shown in FIG. 1), an additional switch (similar to the switch SW5 (or SW7) shown in FIG. 1) between the additional output terminal and the VCOMH operational amplifier 103H, and another additional switch (similar to the switch SW6 (or SW8) shown in FIG. 1) between the additional output terminal and the VCOML operational amplifier 103L. Thus, three or more sets of driving voltages VCOMH and VCOML can be generated.

While the embodiments above are directed to a case where the voltage value of the reference node VREFH is "+5 V", the voltage value of the reference voltage VSS is "0 V", and the voltage value of the reference node VREFL is "−5 V", the divided voltages may be of any other suitable values depending on the characteristics of the liquid crystal display panel to be driven. Moreover, while the embodiments above assume that the voltage value of the driving voltage VCOMH is "+3 V" and the voltage value of the driving voltage VCOML is "−3 V" in the main panel driving operation, and the voltage value of the driving voltage VCOMH is "+2 V" and the voltage value of the driving voltage VCOML is "−2.5 V" in the sub-panel driving operation, it is understood that these settings may be altered depending on the characteristics of the liquid crystal display panel to be driven.

The driving voltage control device of the present invention, being capable of preventing charge from being wasted when switching from one mode to another and capable of quickly switching between the first mode and the second mode, is useful in applications such as a driving voltage control device for driving a plurality of liquid crystal display panels.

What is claimed is:

1. A driving voltage control device operating in a first mode and in a second mode, and comprising a first capacitor, a second capacitor, a third capacitor, a fourth capacitor, and an output section, wherein in the first mode:

the first capacitor receives a first voltage and stores an amount of charge according to a voltage value of the first voltage;

the second capacitor receives a second voltage and stores an amount of charge according to a voltage value of the second voltage; and the output section supplies either one of a voltage according to the amount of charge stored in the first capacitor and a voltage according to the amount of charge stored in the second capacitor to a first output node according to a predetermined timing, and in the second mode:

the third capacitor receives a third voltage and stores an amount of charge according to a voltage value of the third voltage;

the fourth capacitor receives a fourth voltage and stores an amount of charge according to a voltage value of the fourth voltage; and the output section supplies either one of a voltage according to the amount of charge stored in the third capacitor and a voltage according to the amount of charge stored in the fourth capacitor to a second output node according to a predetermined timing.

2. The driving voltage control device of claim 1, further comprising a voltage generation section, wherein in the first mode:

the voltage generation section generates the first and second voltages;

the first capacitor receives the first voltage generated by the voltage generation section; and the second capacitor receives the second voltage generated by the voltage generation section, and in the second mode:

the voltage generation section generates the third and fourth voltages;

the third capacitor receives the third voltage generated by the voltage generation section; and the fourth capacitor receives the fourth voltage generated by the voltage generation section.

3. The driving voltage control device of claim 2, further comprising a first differential amplifier circuit and a second differential amplifier circuit, wherein in the first mode:

the first differential amplifier circuit outputs the first voltage generated by the voltage generation section;

the second differential amplifier circuit outputs the second voltage generated by the voltage generation section;

the first capacitor receives the first voltage output by the first differential amplifier circuit; and the second capacitor receives the second voltage output by the second differential amplifier circuit, and in the second mode:

the first differential amplifier circuit outputs the third voltage generated by the voltage generation section;

the second differential amplifier circuit outputs the fourth voltage generated by the voltage generation section;

the third capacitor receives the third voltage output by the first differential amplifier circuit; and the fourth capacitor receives the fourth voltage output by the second differential amplifier circuit.

4. The driving voltage control device of claim 2, the voltage generation section including a first supply terminal and a second supply terminal, and the driving voltage control device further comprising:

a first switch connected between the first supply terminal and the first capacitor;

a second switch connected between the second supply terminal and the second capacitor;

a third switch connected between the first supply terminal and the third capacitor; and a fourth switch connected between the second supply terminal and the fourth capacitor, wherein in the first mode:

the first supply terminal outputs the first voltage;

the second supply terminal outputs the second voltage;

the first and second switches are turned on; and the third and fourth switches are turned off, and in the second mode:

the first supply terminal outputs the third voltage;

the second supply terminal outputs the fourth voltage;

the first and second switches are turned off; and the third and fourth switches are turned on.

5. The driving voltage control device of claim 4, wherein the driving voltage control device is brought to a switching mode when switching between the first mode and the second mode, with the first to fourth switches being all turned off during the switching mode.

6. The driving voltage control device of claim 1, wherein in the first mode, the output section further supplies either one of the voltage according to the amount of charge stored in the first capacitor and the voltage according to the amount of charge stored in the second capacitor to the second output node.

7. The driving voltage control device of claim 1, wherein in the first mode, the output section further supplies either one of the voltage according to the amount of charge stored in the third capacitor and the voltage according to the amount of charge stored in the fourth capacitor to the second output node.

8. The driving voltage control device of claim 4, further comprising:

a first line having a first node, a second node, and third to sixth nodes present between the first node and the second node; and a second line having a seventh node, an eighth node, and ninth to twelfth nodes present between the seventh node and the eighth node, the output section including:

a fifth switch connected between the third node and the first output node;

a sixth switch connected between the ninth node and the first output node;

a seventh switch connected between the fourth node and the second output node; and an eighth switch connected between the tenth node and the second output node, wherein:

the first supply terminal is connected to the first node;

the second supply terminal is connected to the seventh node;

the first switch is connected between the fifth node and the first capacitor;

the second switch is connected between the eleventh node and the second capacitor;

the third switch is connected between the sixth node and the third capacitor;

the fourth switch is connected between the twelfth node and the fourth capacitor;

in the first mode, the fifth and sixth switches are turned on/off according to a predetermined timing; and in the second mode, the seventh and eighth switches are turned on/off according to a predetermined timing.

9. The driving voltage control device of claim 8, wherein in the first mode, one of the seventh switch and the eighth switch is turned on.

10. The driving voltage control device of claim 8, further comprising a ninth switch connected between the second output node and one of the third capacitor and the fourth capacitor, wherein:

in the first mode, the ninth switch is turned on; and in the second mode, the ninth switch is turned off.

11. A display device, comprising:

the driving voltage control device of claim 1;

a first display panel receiving, at a counter electrode thereof, a voltage supplied to the first output node included in the driving voltage control device;

a first source driver for supplying a data signal to the first display panel;

a second display panel receiving, at a counter electrode thereof, a voltage supplied to the second output node included in the driving voltage control device; and a second source driver for supplying a data signal to the second display panel.

12. A driving voltage control device for supplying a predetermined voltage to a counter electrode of each of a first display panel and a second display panel, the driving voltage control device operating in a first mode and in a second mode, and comprising a first capacitor, a second capacitor, a third capacitor, a fourth capacitor, and an output section, wherein in the first mode:

the first capacitor receives a first voltage from outside and stores an amount of charge according to a voltage value of the first voltage;

the second capacitor receives a second voltage from outside and stores an amount of charge according to a voltage value of the second voltage; and the output section supplies either one of a voltage according to the amount of charge stored in the first capacitor and a voltage according to the amount of charge stored in the second capacitor to the counter electrode of the first display panel according to a predetermined timing, and in the second mode:

the third capacitor receives a third voltage from outside and stores an amount of charge according to a voltage value of the third voltage;

the fourth capacitor receives a fourth voltage from outside and stores an amount of charge according to a voltage value of the fourth voltage; and the output section supplies ether one of a voltage according to the amount of charge stored in the third capacitor and a voltage according to the amount of charge stored in the fourth capacitor to the counter electrode of the second display panel according to a predetermined timing.

13. A driving voltage control method having a first mode and a second mode, and comprising a step (a), a step (b) and a step (c), wherein in the first mode:

the step (a) is a step of applying a first voltage to a first capacitor;

the step (b) is a step of applying a second voltage to a second capacitor; and the step (c) is a step of supplying either one of a voltage according to an amount of charge stored in the first capacitor and a voltage according to an amount of charge stored in the second capacitor to a first output node according to a predetermined timing, and in the second mode:

the step (a) is a step of applying a third voltage to a third capacitor;

the step (b) is a step of applying a fourth voltage to a fourth capacitor; and the step (c) is a step of supplying either one of a voltage according to an amount of charge stored in the third capacitor and a voltage according to an amount of charge stored in the fourth capacitor to a second output node according to a predetermined timing.

14. The driving voltage control method of claim 13, further comprising a step (d), wherein in the first mode, the step (d) is a step of supplying either one of the voltage according to the amount of charge stored in the first capacitor and the voltage according to the amount of charge stored in the second capacitor to the second output node.

15. The driving voltage control method of claim 13, further comprising a step (d), wherein in the first mode, the step (d) is a step of supplying either one of the voltage according to the amount of charge stored in the third capacitor and the voltage according to the amount of charge stored in the fourth capacitor to the second output node.

* * * * *